US011864673B2

(12) United States Patent
Kramer

(10) Patent No.: US 11,864,673 B2
(45) Date of Patent: Jan. 9, 2024

(54) VESSEL MATE DRINKING ACCESSORY

(71) Applicant: Russell Kramer, Sandwich, MA (US)

(72) Inventor: Russell Kramer, Sandwich, MA (US)

( * ) Notice: Subject to any disclaimer, the term of this patent is extended or adjusted under 35 U.S.C. 154(b) by 202 days.

(21) Appl. No.: 17/176,082

(22) Filed: Feb. 15, 2021

(65) Prior Publication Data

US 2021/0282578 A1 Sep. 16, 2021

Related U.S. Application Data

(60) Provisional application No. 62/988,228, filed on Mar. 11, 2020.

(51) Int. Cl.
*A47G 19/22* (2006.01)

(52) U.S. Cl.
CPC ..... *A47G 19/2272* (2013.01); *A47G 19/2288* (2013.01)

(58) Field of Classification Search
CPC ..... B65D 2543/00537; A47G 19/2288; A47G 19/2272; A47G 19/2266
USPC ..... 220/711, 710.5, 703, 592.2, 592.17, 220/574.2, 212.5
See application file for complete search history.

(56) References Cited

U.S. PATENT DOCUMENTS 5,987,913 A * 11/1999 Andrzejczak ..... A47G 19/02 62/457.2
2014/0158699 A1* 6/2014 Kim ..... A47G 19/2272 220/709
2016/0088960 A1* 3/2016 Liang ..... A47G 19/2288 220/560.01
2019/0307292 A1* 10/2019 Haas ..... B65D 81/3869
2023/0159257 A1* 5/2023 Lambert ..... A47G 19/2205 426/2

* cited by examiner

*Primary Examiner* — James N Smalley
*Assistant Examiner* — Madison L Poos
(74) *Attorney, Agent, or Firm* — Jonathan B. David

(57) ABSTRACT

A system comprises a device configured at a first position. A jar rim is configured at a second position. The jar rim is configured to couple with the device to enable the device to provide an additional use in addition to an original use. An inner connector is configured to enable the jar rim to couple to the device to allow the device to provide the additional use. A heat sink is configured within the device after the jar rim is configured with the device, wherein the heat sink is configured to maintain a temperature of one or more liquids within the device. One or more holes are configured at a top portion of the coupled jar rim and device to further enable the additional use to be provided.

5 Claims, 24 Drawing Sheets

Figure 5C
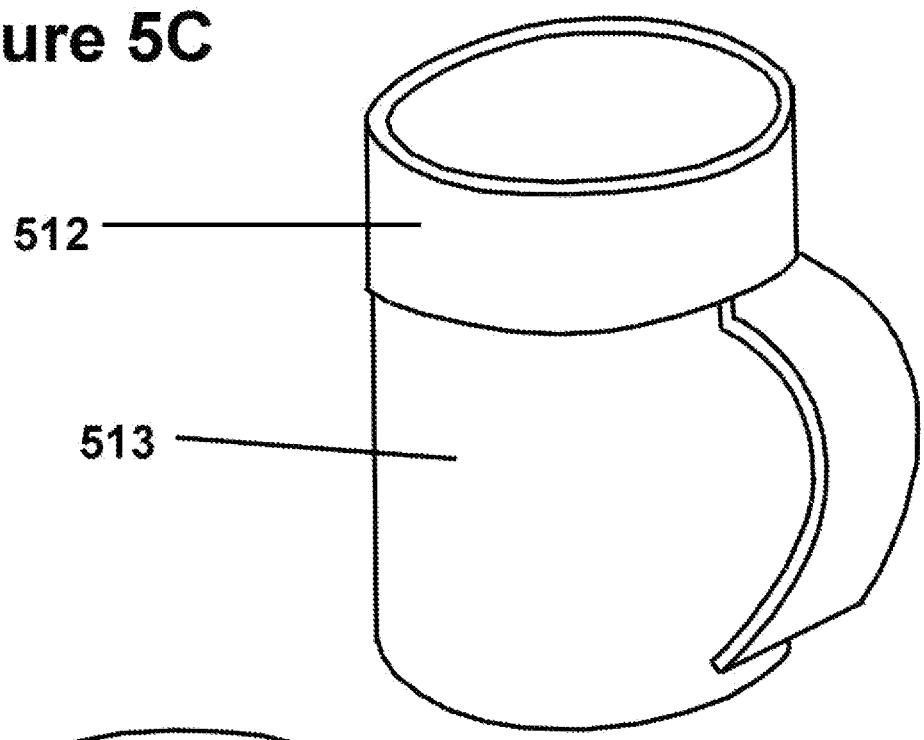
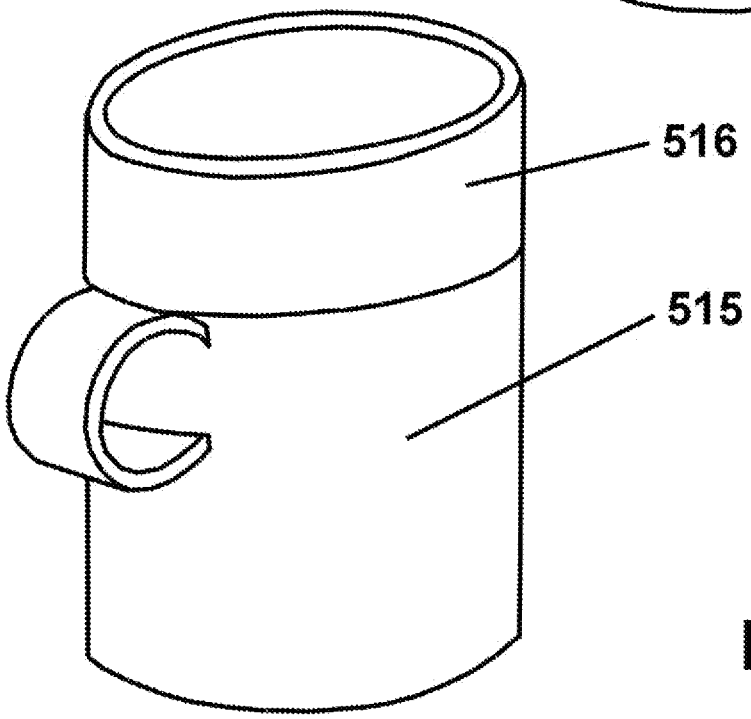
Figure 5D

VESSEL MATE DRINKING ACCESSORY

TECHNICAL FIELD

This application relates in general to an article of manufacture for providing a drinking accessory capable of coupling with an ordinary jar or can to enable the ordinary jar or can to provide an additional function to users.

BACKGROUND

An established means of means of converting glass jars into glasses or glassware is with the use of glass cutters, scoring tools and appropriate files. The cutting process requires skill where the threaded portion and tapered section of bottles and jars are cut off so as to eliminate the appearance of being a used jar, can, or bottle, i.e. trash. Various files and other abrasives may be used to smooth out the extremely sharp edges that may be produced by the glass-cutter. A similar process can be used to convert plastic jars into plastic ware with scoring cutters often used on plexiglass sheets and various abrasives to smooth out the sharp edge or edges produced by the scoring tool.

While both glass and plastic jars can functionally serve as vessels from which to drink and to be used for other purposes it is desirable to eliminate the threaded portions and tapered portions of the original jars or bottles leaving a generally cylindrical vessel referred to as a glass or tumbler. The ridged surface from the threads require more attention to clean thoroughly. The threads present a ridge surface that contacts the lips while drinking, where a smooth surface is more desirable. Moreover, such glasses and tumblers generally have no handles that enable users to hold and drink the beverage.

Various sized and shaped jars can additionally serve as vases and planters among a variety of repurposing applications where eliminating the appearance of the threaded and tapered portion of the jars are desirable. Another type of jar, known as a Mason™ jar has a threaded cover with a removable insert. Once the insert is removed the threaded portion of the cover can be screwed on with an opening and the resulting configuration can be used as a glass. The metal screw on portion does leave some of the threaded portion of the jar exposed along with the tapered portion of the jar and the metal screw-on portion.

The present invention attempts to address the existing add-on accessory for jars for providing a drinking accessory capable of coupling with an ordinary bottle, jar, or can according to the principles and example embodiments disclosed herein. The present invention provides a solution to convert ordinary jars and cans into functional drinking accessories.

SUMMARY

A system can include a device configured at a first position. The system can also include a jar rim configured at a second position, wherein the jar rim is initially configured apart from the device, and wherein the jar rim is configured to couple with the device to enable the device to provide an additional use in addition to an original use that the device was configured to provide. Further, the system includes a inner connector configured on the jar rim, wherein the inner connector is configured to enable the jar rim to couple to the device to allow the device to provide the additional use. In addition, the system includes a heat sink configured within the device after the jar rim is configured with the device, wherein the heat sink is configured to maintain a temperature of one or more liquids within the device. The system also includes one or more holes configured at a top portion of the coupled jar rim and device to enable the additional use to be provided.

A system can include a jar rim configured at a first position. The system also includes a jar lid configured at a second position, wherein the jar lid is configured to be placed in contact with the jar rim and couple with the jar rim, and wherein the coupled jar lid and jar rim are configured to be able to connect with one or more liquid containing devices and/or item containing devices. Further, the system includes a holding device configured to hold liquids and/or items, wherein the holding device is configured to connect with the coupled jar mate and jar rim and be configured to provide an additional use based on the holding device being connected to the coupled jar lid and jar rim. The system also includes one or more holes configured at a top portion of the coupled jar rim, jar lid and holding device to enable the additional use to be provided.

A method includes configuring a holding device at a first position. The method also includes positioning a jar rim at a second position above the holding device, wherein the jar rim is configured to connect with the holding device to convert the holding device into an apparatus that performs an additional function, and wherein the jar rim is configured to connect with another device to enable the holding device to perform the additional function. Further, the method includes configuring an inner connector/liner on the jar rim, wherein the inner liner/connector is configured on the jar rim to enable the jar rim to be secured onto the holding device. In addition, the method includes configuring a heat sink within the holding device after the jar rim is configured with the device, wherein the heat sink is configured to maintain a temperature of one or more liquids within the device. Further, the method includes positioning one or more holes at a top portion of the coupled jar rim and device to enable the additional use to be provided.

BRIEF DESCRIPTION OF THE DRAWINGS

Referring now to the drawings in which like reference numbers represent corresponding parts throughout:

FIG. 5(A)-(D) illustrates various potential embodiments of vessel accessories capable of coupling with an ordinary jar according to the present invention;

DETAILED DESCRIPTION

Figure 1:
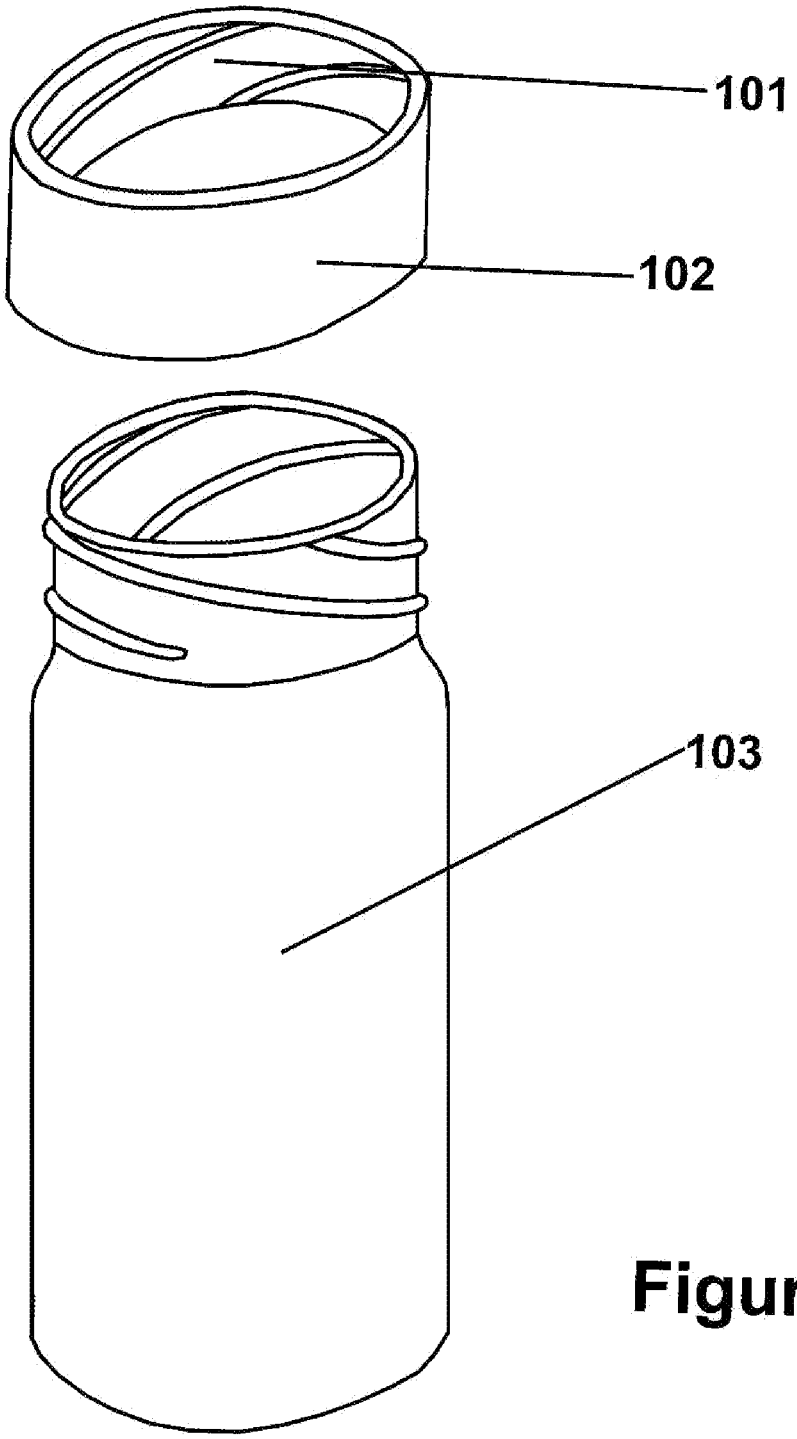
FIG. 1 illustrates one potential embodiment an article of manufacture for providing a drinking accessory capable of coupling with an ordinary jar according to the present invention.

This application relates in general an article of manufacture for providing a drinking accessory capable of coupling with an ordinary jar or can.

Various embodiments of the present invention will be described in detail with reference to the drawings, wherein like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

In describing embodiments of the present invention, the following terminology will be used. The singular forms "a," "an," and "the" include plural referents unless the context clearly dictates otherwise. Thus, for example, reference to "a needle" includes reference to one or more of such needles and "etching" includes one or more of such steps. As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. As used herein, the singular forms "a," "an," and "the" are intended to include the plural forms as well, unless the context clearly indicates otherwise.

It further will be understood that the terms "comprises," "comprising," "includes," and "including" specify the presence of stated features, steps, or components but do not preclude the presence or addition of one or more other features, steps, or components. It also should be noted that in some alternative implementations, the functions and acts noted may occur out of the order noted in the figures. For example, two figures shown in succession may in fact be executed substantially concurrently or may sometimes be executed in the reverse order, depending upon the functionality and acts involved.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "50-250 micrometers should be interpreted to include not only the explicitly recited values of about 50 micrometers and 250 micrometers, but also include individual values and sub-ranges within the indicated range. Thus, included in this numerical range are individual values such as 60, 70, and 80 micrometers, and sub-ranges such as from 50-100 micrometers, from 100-200, and from 100-250 micrometers, etc.

Unless otherwise indicated, all numbers expressing quantities of ingredients, properties such as molecular weight, percent, ratio, reaction conditions, and so forth used in the specification and claims are to be understood as being modified in all instances by the term "about," whether or not the term "about" is present. Accordingly, unless indicated to the contrary, the numerical parameters set forth in the specification and claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in the testing measurements.

As used herein, the term "about" means that dimensions, sizes, formulations, parameters, shapes and other quantities and characteristics are not and need not be exact, but may be approximated and/or larger or smaller, as desired, reflecting tolerances, conversion factors, rounding off, measurement error and the like and other factors known to those of skill. Further, unless otherwise stated, the term "about" shall expressly include "exactly," consistent with the discussion above regarding ranges and numerical data.

In general, the present disclosure relates general an article of manufacture for providing a drinking accessory capable of coupling with an ordinary jar or can.

Referring to FIG. 1, one potential embodiment an article of manufacture for providing a drinking accessory capable of coupling with an ordinary jar according to the present invention is illustrated. This embodiment shows a jar rim 102 being added to an ordinary jar 103. The jar 103 can contain a series of threads on its outer rim. An inner lining 101 of the jar rim 102 engages the threads at the top of the jar 103 to hold the jar rim 102 securely in place. The jar 103 can be configured with threads around the perimeter of the top portion of the jar 103. Moreover, the threads configure the jar 103 to mate or couple with the jar rim 102.

In FIG. 1, a variety of attempts can be made to couple components onto jars such as the jar 103 described in FIG. 1. Moreover, vessels used for various purposes in their basic form include: Tumblers, both glass and plastic, metal cans, jars, both glass and plastic, mugs, typically glass or ceramic, vases, typically glass or ceramic, lower pots typically clay, plastic or ceramic, paper cups and larger containers, and Styrofoam™ cups and larger containers. Various means have been pursued to improve the versatility and functionality of these and other vessels for greater convenience, performance, health and safety. Standard open mugs have been transformed into travel mugs for example. Moreover, converting discarded jars and cans into attractive glass and plastic and metal ware to repurpose what would otherwise contribute to the vast waste stream of discarded plastic and glass jars and metal cans while providing the user a trove of attractive glass and plastic and metal ware for home use can occur.

In FIG. 1 and other embodiments, Vessel Mate™, as disclosed herein as the present invention, is a universal adapter and conversion kit for creating a drinking accessory suitable for existing plastic and glass, ceramic, Styrofoam, and paper ware along with glass and plastic jars and metal cans and holding jars. This drinking accessory consists of a series of modular, interchangeable components designed to be used in different combinations to enhance the functionality, safety, and or appearance of the above described vessels in a variety of ways and in a variety of different combinations as needed. The first component is the cylindrical adapter ring which attaches to the top of the vessel around the perimeter. Vessel Mate™ provides a series of interchangeable components to add additional use and functionality to standard holding devices such as cans and or jars.

In FIG. 1 and the various embodiments disclosed herein, example jars are shown as descriptive attempts to illustrate how the present invention may be created using ordinary jars that typically are provided to consumers when purchasing food. In addition to the Mason™ jar mentioned above, other possible example jars such as the jar 103 described above, may include mayonnaise jars, tomato sauce jars, fruit and vegetable jars, and many others. The size and shape of these jars that are emptied when the original contents is consumed may dictate possible uses for these jars when the present invention is added thereto. None of these examples are meant to limit the scope of the present invention beyond any limitations recited in patent claims prepared for prosecution. Such jars originally carrying such condiments can be cleaned and then provided with the various components of Vessel Mate™ to provide additional functions of the jars.

Figure 2:
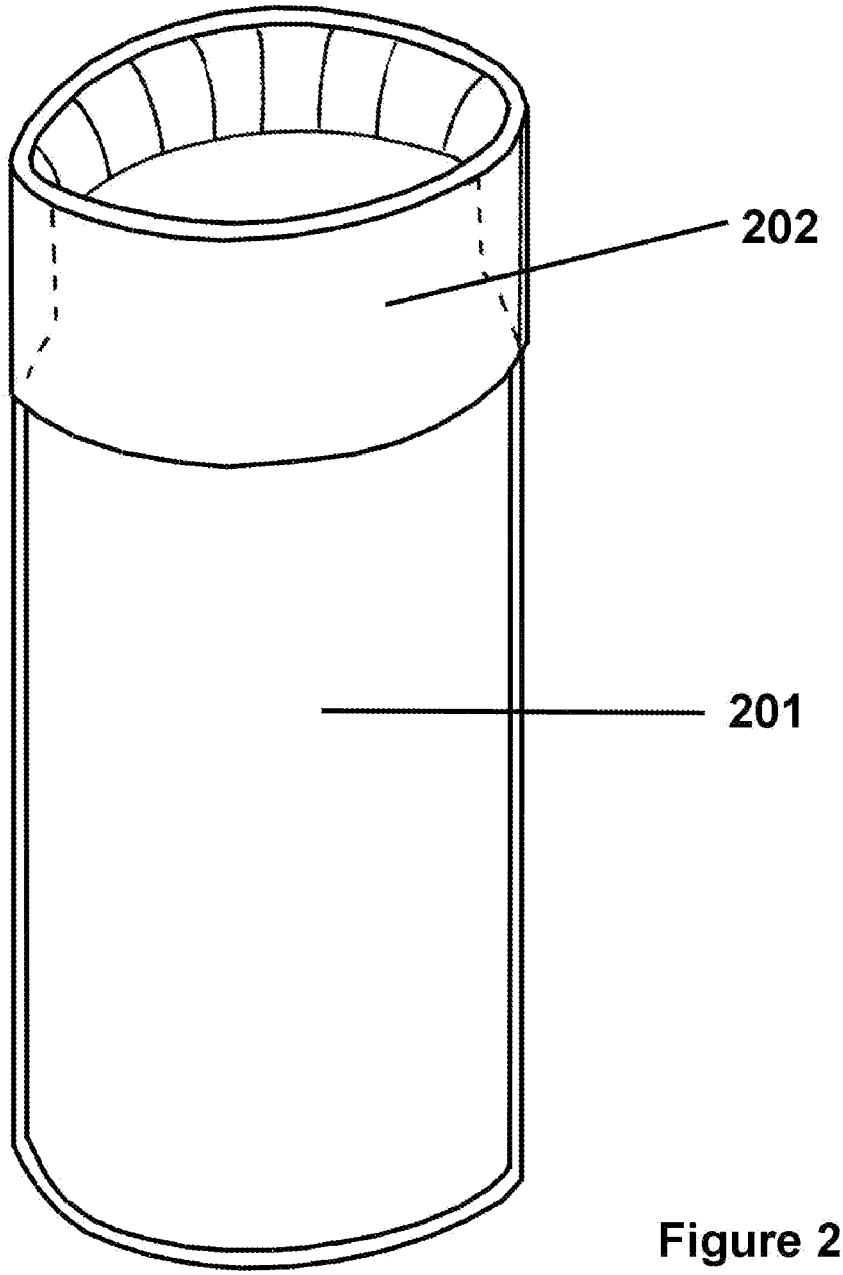
FIG. 2 illustrates another potential embodiment for a drinking accessory for providing an item capable of coupling with an ordinary jar according to the present invention.

FIG. 2 illustrates another potential embodiment for a drinking accessory for providing an item capable of coupling with an ordinary jar according to the present invention. A jar 201 is shown having a mating jar rim 202 attached to the top opening of the jar 201. Unlike FIG. 1, other embodiments can illustrate a jar or holding device with no inner threads to mate with a mating jar rim or the like. In this example embodiment, no threads are shown with hidden lines that would couple with the jar rim 201 as was discussed above with reference to FIG. 1. The jar rim 201 is shaped to match the type of jar with any lips or edges that may be engaged to hold the jar rim 201 in place. A specific version of the jar rim 201 would be needed for a particular jar, such as a popular national brand of pickles, mayonnaise, or the like. The jar rim 202 can also be adjusted to match the shape of the particular jar or can in other embodiments. The jar rim 202 being configured to match the shape of the particular jar or holding device allows the jar rim 202 to be able to allow the jar 201 to be provided with another function in addition to its original functioning of storing food and other materials.

FIG. 3(A)-(E) illustrate various potential embodiments of vessel handle accessory capable of coupling with an ordinary jar according to the present invention. In addition to a jar rim, other components can be combined with the jar rim to then connect or mate with a jar or can or holding device. A multitude of components can be used with the jar rim to then connect with jars and cans and also holding devices. In this particular embodiment, a jar rim 301 is sized to mate with a jar lid 302 before the combination of these components are coupled to a jar 303 using its threads as discussed above. In this particular example, the jar lid 302 shows an opening 304 that may permit a straw or similar drinking device to be used while the jar rim 301 and jar lid 302 are coupled to the jar 303. Drinking utensils other than straws can also be used within the opening 304. Spoons can be placed within the opening as well. As disclosed herein, the number and types of openings and lid combinations may vary to allow multiple uses of the jar 303.

Figure 3A:
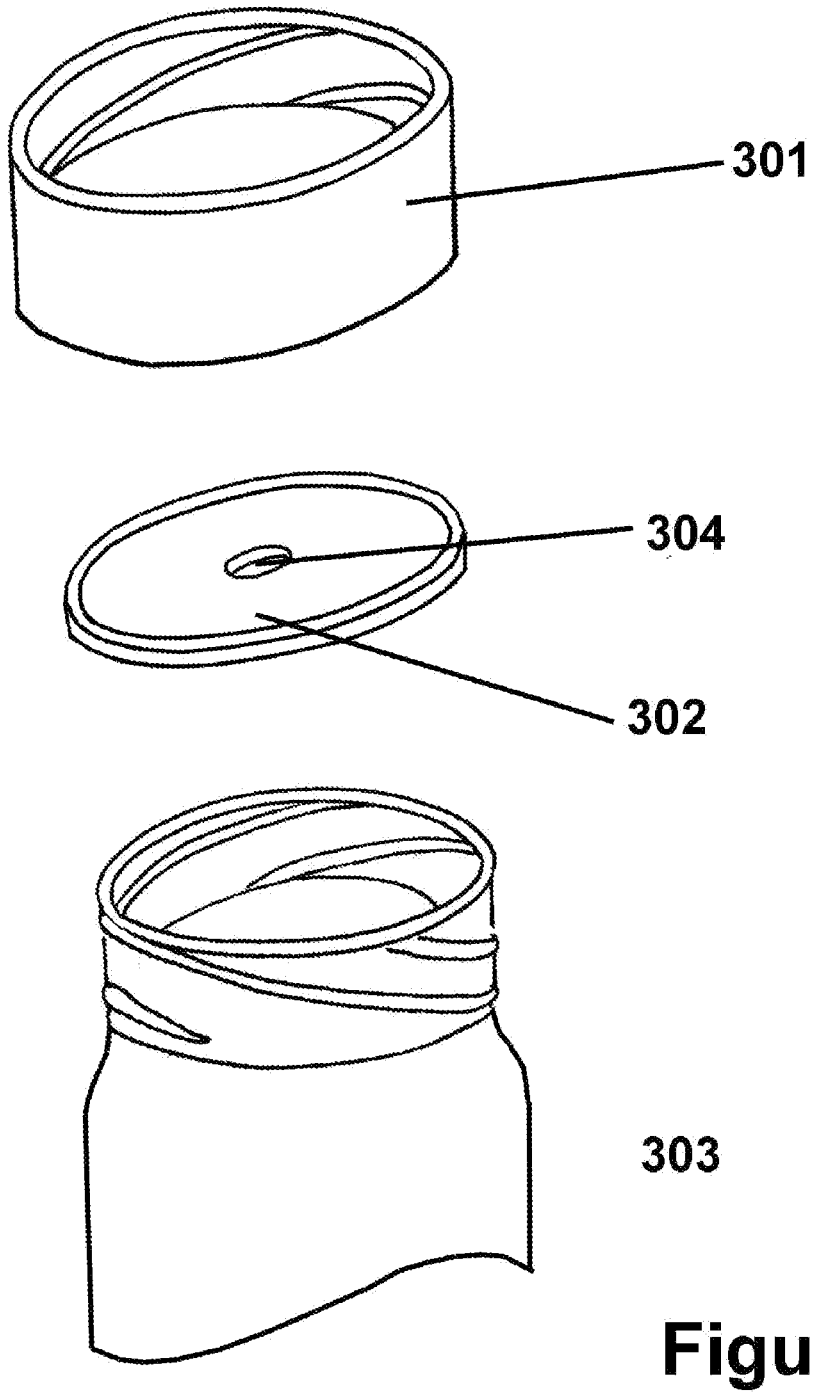
FIG. 3(A)-3(E) illustrates a potential embodiment of a drinking accessory for providing an item with a lid capable of coupling with an ordinary jar according to the present invention.
Figure 3B:
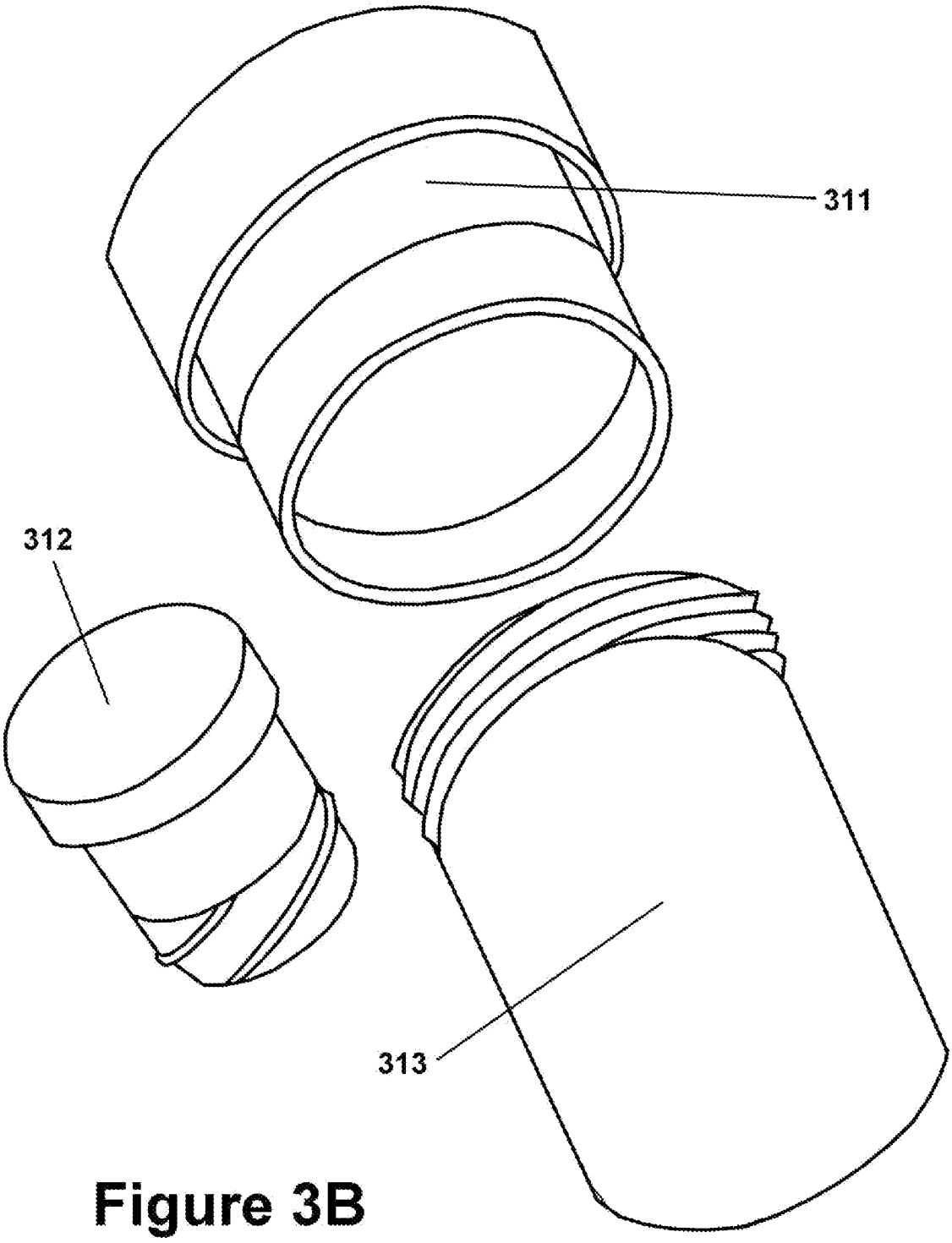
Figure 3C:
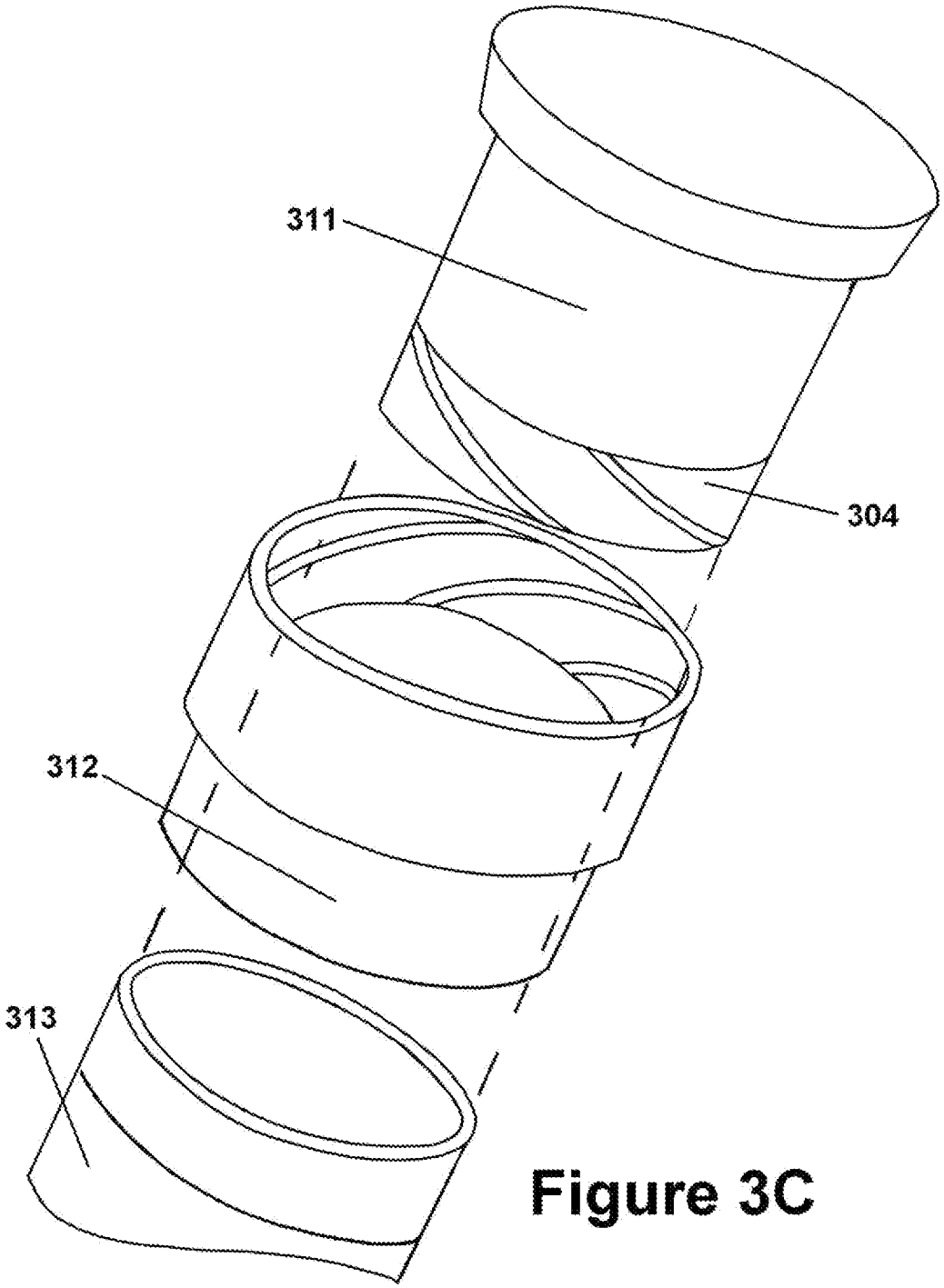
Figure 3D:
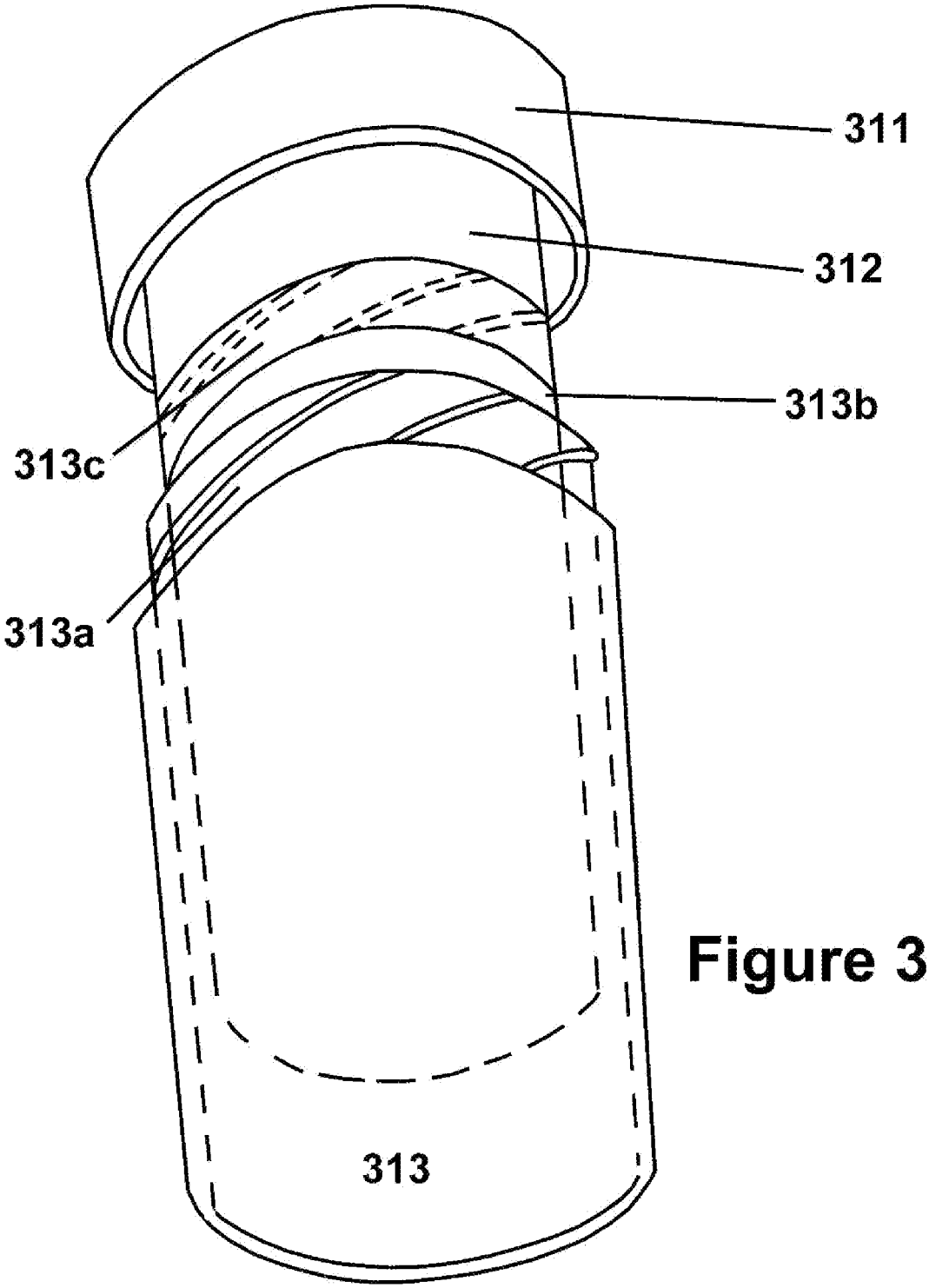

With respect to FIGS. 3(B)-(E), it is often desirable to maintain the temperature of the liquid as long as possible, generally hot or cold and thus thermoses were invented. Vessel Mate™ includes a special fixture which readily adapts your otherwise discarded jar into a vacuum thermos as shown in FIGS. 3(B)-(E). FIG. 3(D) shows an extended version of Vessel Mate™. It includes a cylindrical extension 312 with an interior screw thread or universal threadless adapter 313*b*. A thermal liner 313 which has a corresponding exterior screw thread, 313*a* which securely fastens to the interior threadless adapter of Vessel Mate™ 313*b*. This creates a seal between the two components. The cap 311 has a cylindrical extension with threaded section. This cap 311 passes through the main Vessel Mate™ fixture 312 and screws into the thermal liner interior 313 screw thread, 313*a*. Accordingly, with the use of the thermal liner 313 in the configuration described above, the temperature of the liquid can be maintained in the same manner as a thermos built into a coffee or travel mug. Portable components such as the thermal liner 313 can be placed within the jar 303 to ensure that any liquid that that the jar 303 is containing has a constant temperature.

Figure 3E:
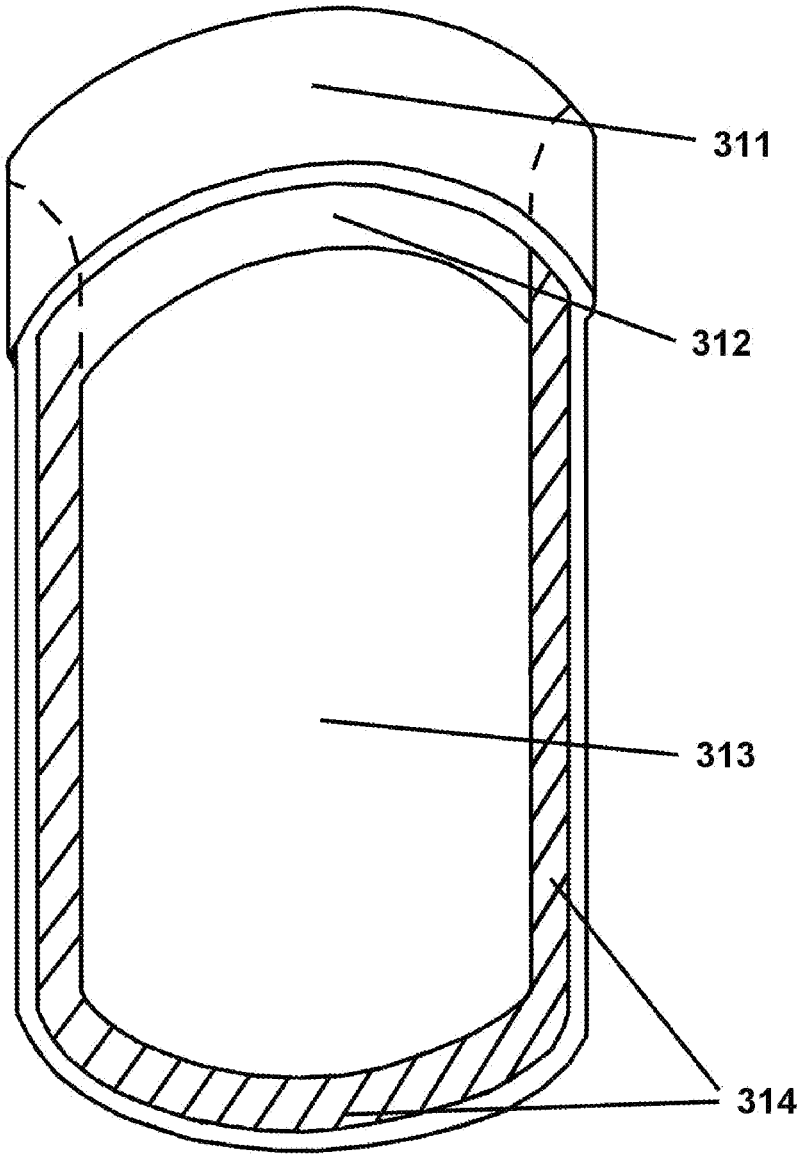

FIG. 3(D) illustrates the glass or plastic jar to be repurposed with its original exterior thread, which passes over the thermal liner 313 and screws into the original interior Vessel Mate™ thread 313*a*, not shown. The combination of these components results into a vessel in which a vacuum is created between the inner wall of the glass or plastic jar, 313*b* and the outer wall of the thermal liner, 313*c*, thereby creating a vacuum thermos. To seal off the thermal-liner chamber, the thermos cap 311 passes through the Vessel Mate™ thread 313*a* to screw into the inner threads of the thermal liner 313. The result is a fully sealed vacuum thermos as shown in FIG. 3(E). A thermos is created from the jar 303 due to the portable configurations including the thermal liner 313 and Vessel Mate™ thread 313*a*.

Figure 4A:
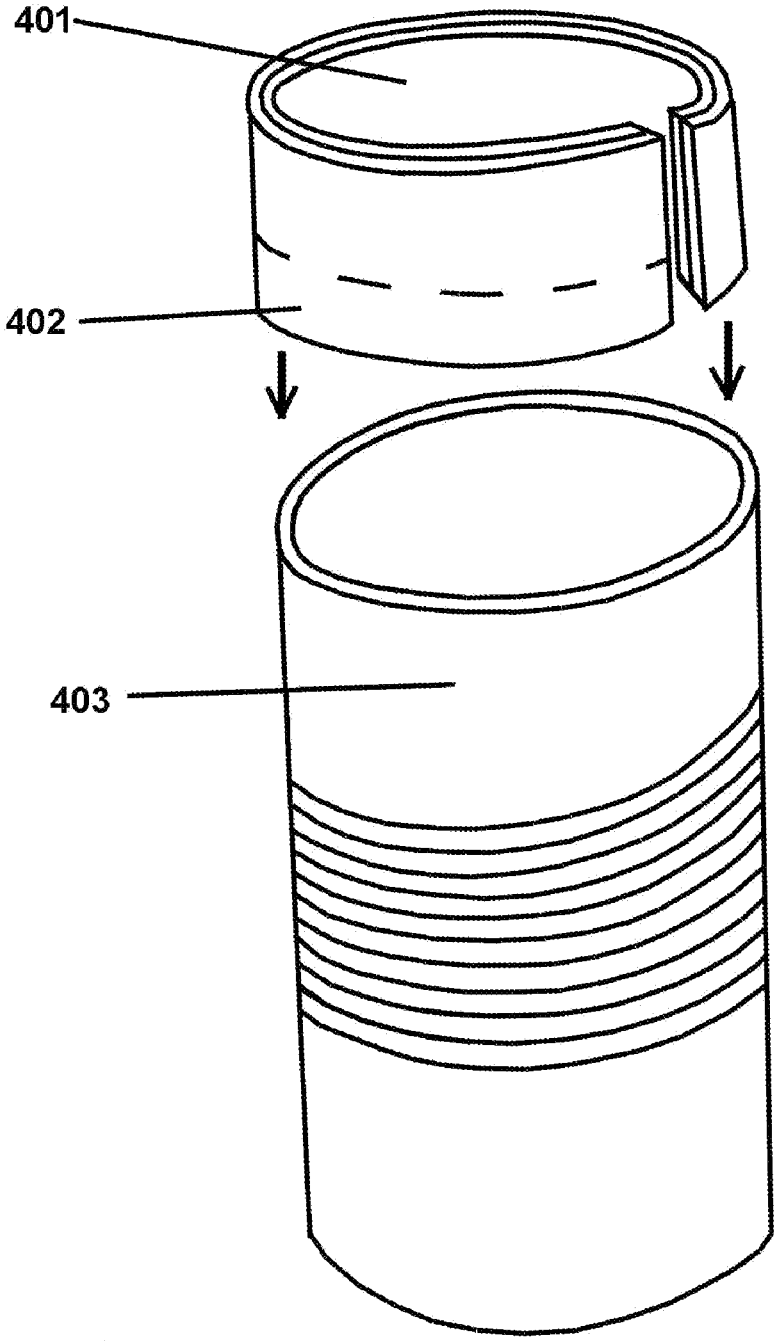
FIG. 4(A)-(B) illustrates an embodiment for a drinking accessory for providing an item capable of coupling with an ordinary can according to the present invention.
Figure 4B:
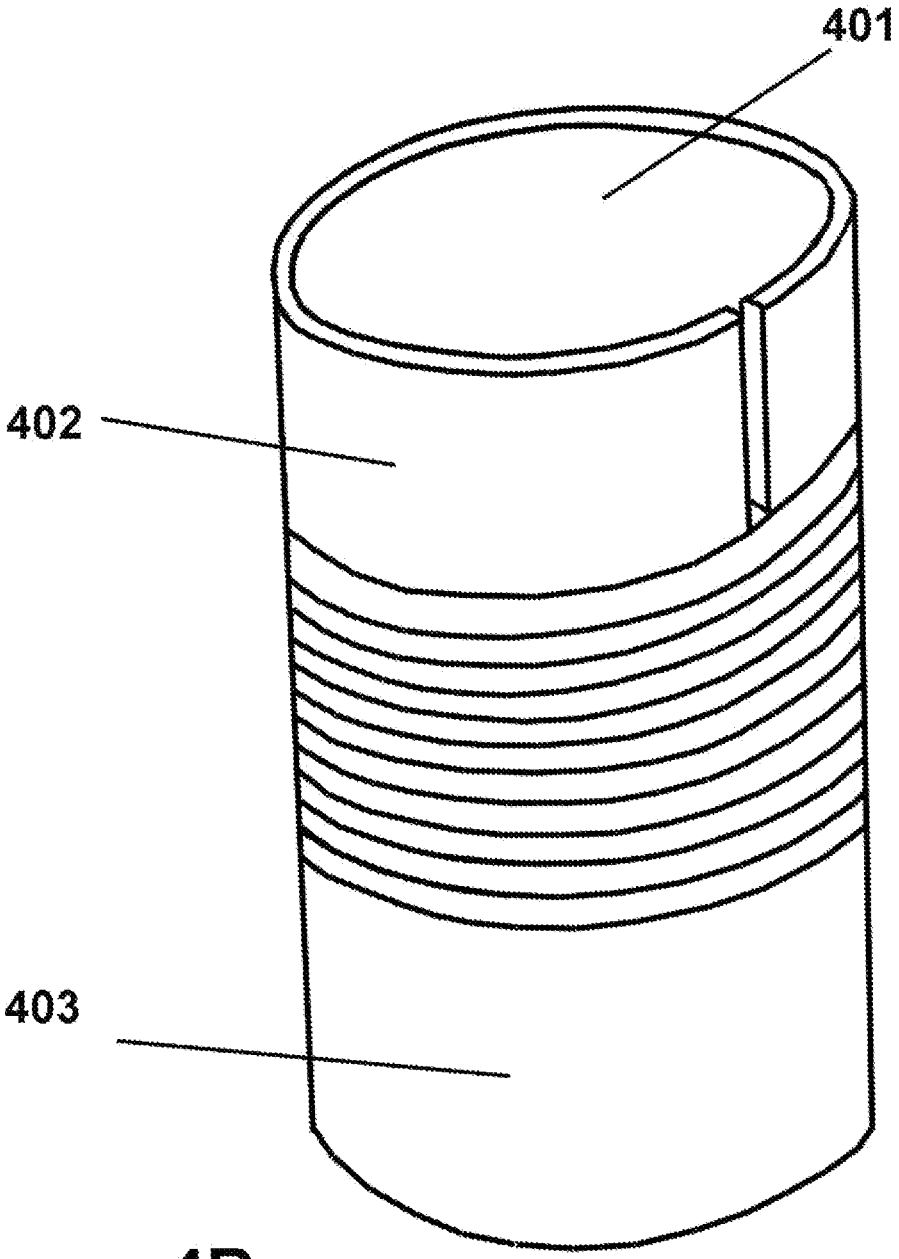

FIGS. 4(A)-(B) illustrates an instrument clamping arrangement for a drinking accessory for providing an item capable of coupling with an ordinary can according to the present invention. Other types of holding devices can be used in addition to jars described above. The additional and portable components can also protect users from a can and the condiments that the can typically holds. In this particular embodiment, a can rim 402 that contains an opening 401 is coupled to a metal or aluminum can 403 in place of a jar from other embodiments. The can rim 402 protects users of the can and rim combination from rough edges created in the can 403 when it was opened, and its contents removed for consumption. The rough edges of the can 403 and the condiments within the can 403 could potentially harm users. The can rim 402 protects users from the rough edges in and around the can 403 and from the condiments which can fall out of the can 403. While this example shows how a can 403 may be turned into a drinking vessel with the addition of a can rim 402, other types of rim/lid combination may be used here as well.

In FIGS. 4(A)-(B), the can rim 402 may couple to the can 403 in a number of ways. A magnet may be located around the inner surface of the can rim 403 if the can 403 contains ferrous metals to which the magnet will attach. The can rim 403 may also match the shape of the can 403 as discussed above in reference to FIG. 2 to securely attach the two items together. All other uses disclosed herein are possible with the use of rims to cans as disclosed in FIG. 4.

FIG. 5(A)-(D) illustrate various potential embodiments of vessel handle accessory capable of coupling with an ordinary jar according to the present invention. Other potential portable components that can be added onto a holding device like jar or can is a handle that is typically found in coffee or beer mugs. A jar rim in addition to a handle can give an ordinary can or jar the same functional use has coffee mugs and travel mugs. Moreover, it is desirable to have a handle with cups and glasses.

In FIGS. 5(A)-(D), Vessel Mate™, the present invention, may provide an option to couple a handle 503 either built into a jar rim 501, or attached to the jar rim 501 by means of Velcro™, magnets, and any other mechanism disclosed herein. The handle 503 fastens to the jar 502 in the manner previously described instantly producing a drinking vessel with a handle, while concealing the threaded and tapered portion of the jar 502. Of course, handles of many types may be created to be coupled to a jar rim 501. Any such attached device may be coupled to the jar 502 when the jar rim 501 having the attached device is coupled to the jar. Portable components such as the jar rim 501 and handle 503 can couple to the jar 502 to transform a holding jar 502 into a drinking vessel similar to a beer mug or coffee mug. Moreover, when carrying warm liquids, the jar 502 can include a thermal liner to keep the liquid warm as described above in FIGS. 3(A)-3(E). As such, the jar 502 can have a rotatable handle 503 while having a thermal liner configured in an interior region of the jar 503 (as shown in FIGS. 3(A)-3(E))) to ensure that the temperature of the liquid in the jar 502 is held constant for the time which the user requires.

FIGS. 5(A)-(D) illustrate how it is desirable to have options with respect to holding the cup. Some may prefer to grip the cup around the cylindrical surface while others may prefer a handle. Thus a means to provide both options is useful. Also when using a main adapter with flow rate holes it may be the handle is situated along the same axis as the flow rate hole being used. This would lead to an awkward position of the cup during use. Thus the ability to reposition the handle so the flow rate hole being used is at or about 90 degree with respect to the handle is desirable. Further, the user having the option to rotate the handle 503 give the user the option of always having a firm and comfortable grip on the jar 502 whether the user is standing, sitting, or walking with the jar 502.

Figure 5A:
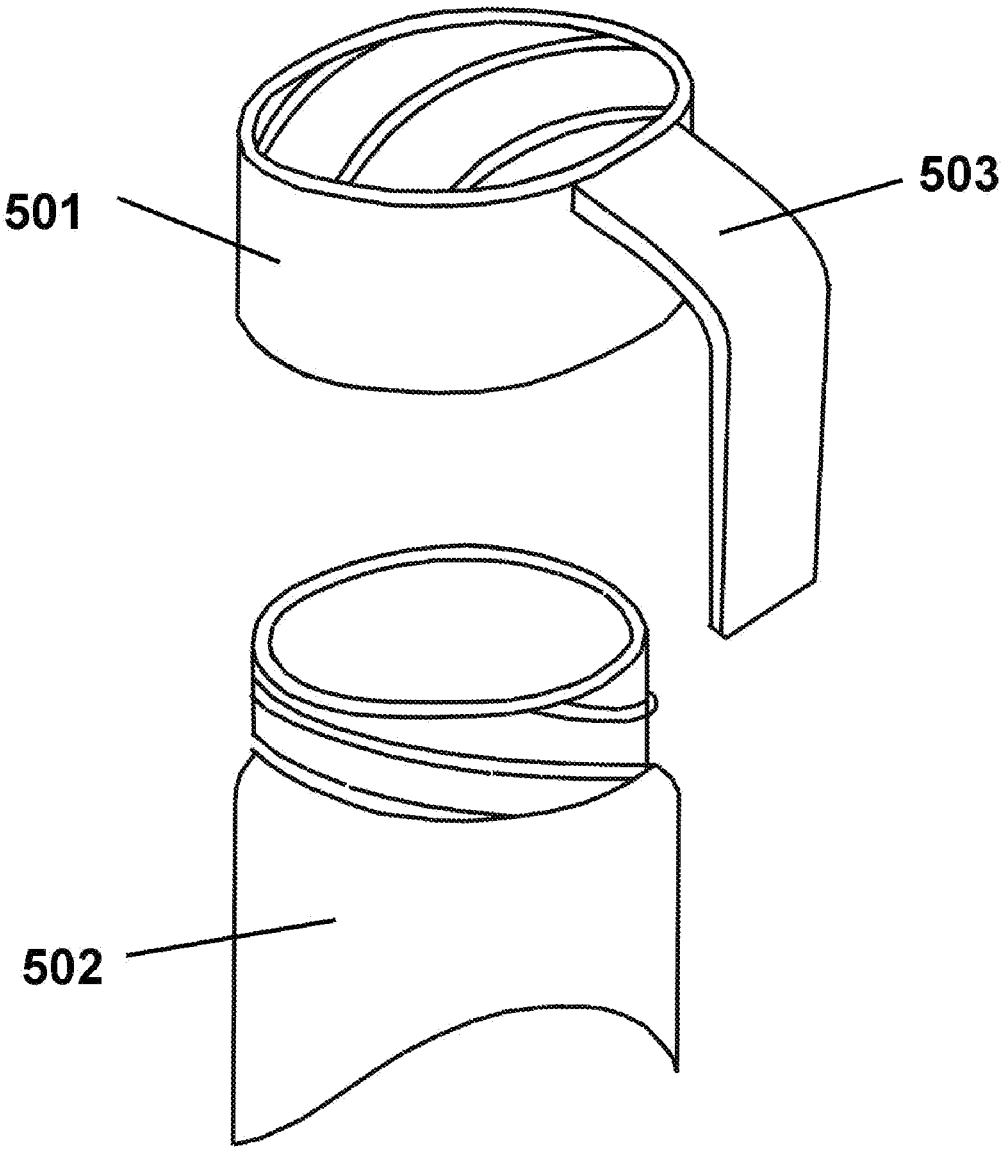
Figure 5B:
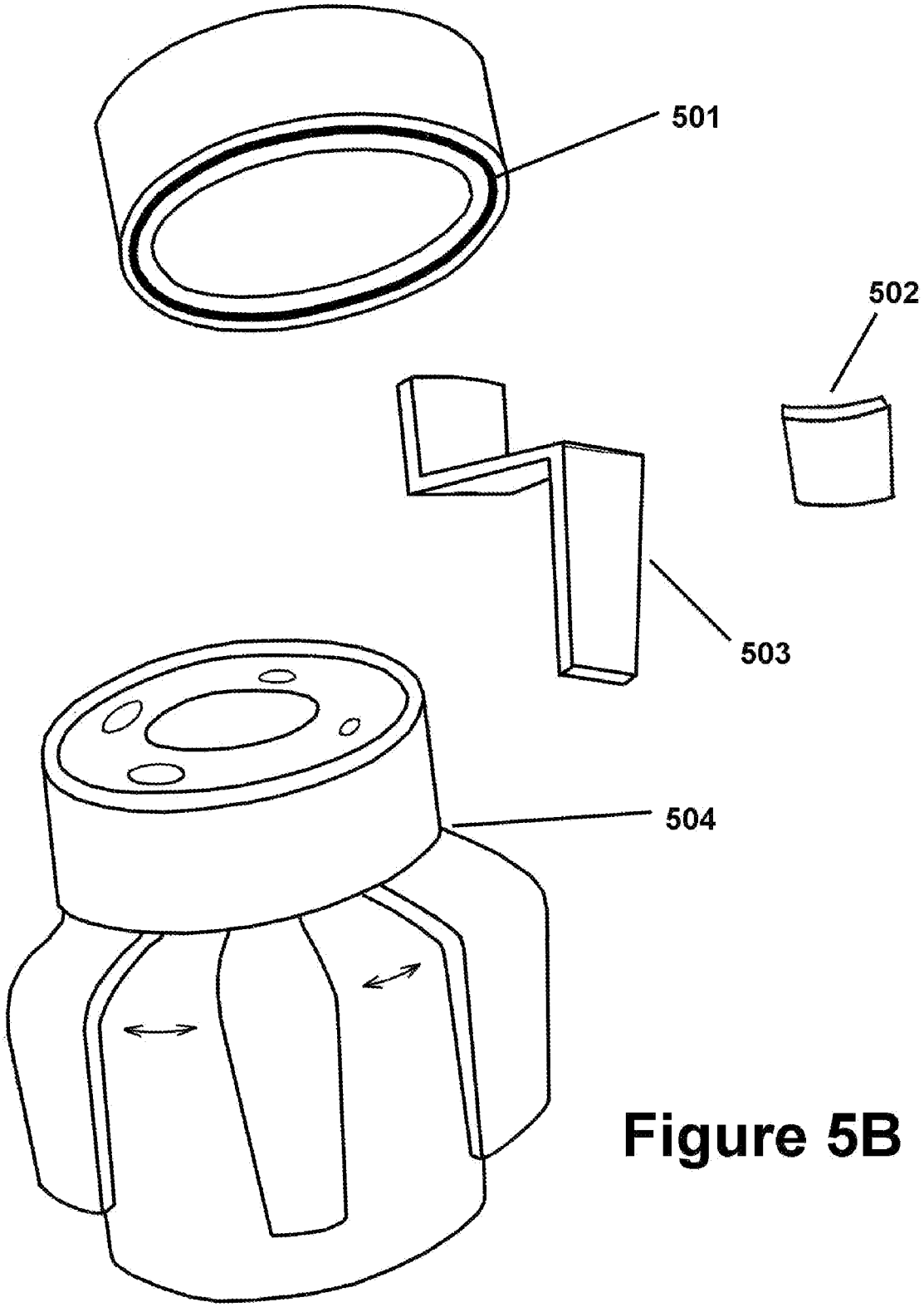

FIG. 5(B) shows a modular handle 503 with a vertical flange. A main adapter with a circular channel extends up into the wall of the adapter to the same height as the height of a vertical flange. The said vertical flange includes a curved surface with the same radius as the circular channel. This allows the vertical flange to be inserted into the circular channel 5E such that when affixed to the jar 502, the handle 503 may rotate around the perimeter of the jar 502 to any desired position with respect to various flow rate holes. In the present embodiment, five flow rate holes are illustrated. In other embodiments, more than five flow rate holes are illustrated. The circular channel also allows a variety of modular handles with the same vertical channel but otherwise of various sizes, shapes and colors to provide the users alternate aesthetics, grips and so forth.

FIGS. 5(C)-(D) also illustrate additional handles possessing shaped in different ways to create different surfaces for gripping the handles as illustrated by 512, 513, 515, and 516. Moreover, in FIGS. 5(C)-(D), the shapes of the handles can different and have different curvatures.

Figure 6:
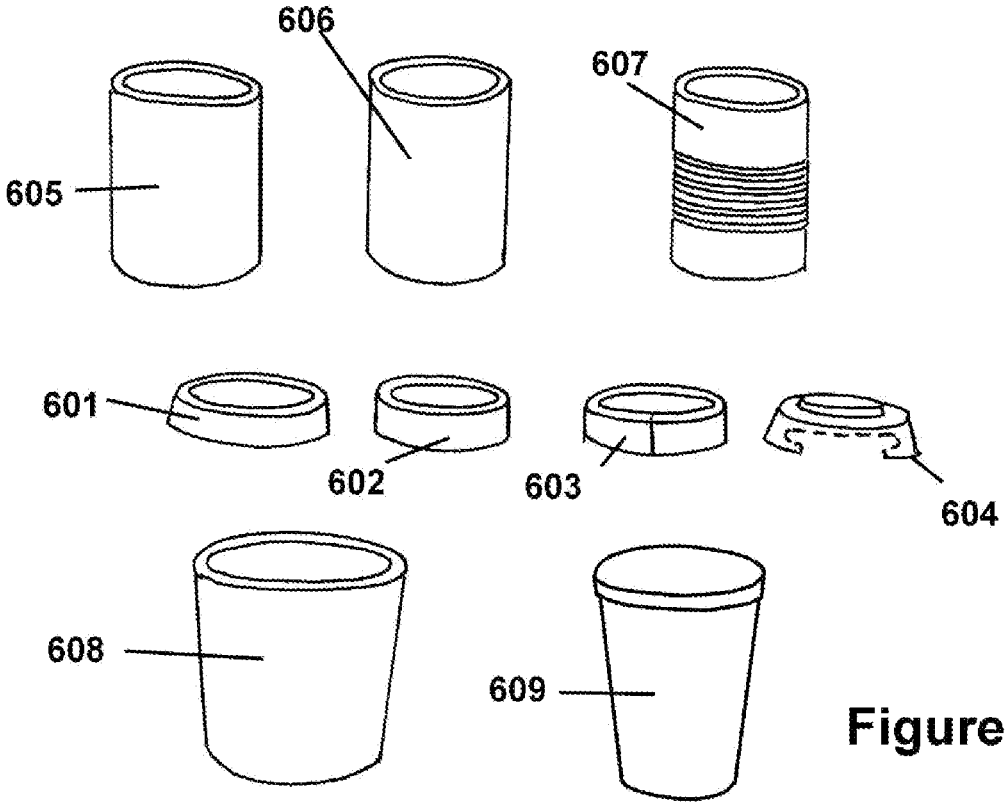
FIG. 6 illustrates various different embodiments for a drinking accessory for providing an item capable of coupling with an ordinary jar or can according to the present invention.

FIG. 6 illustrates various different embodiments for a drinking accessory for providing an item capable of coupling with an ordinary jar or can according to the present invention. Various containers suitable for used with the present invention including glass 605, ceramic, plastic 606, metal 607, paper 608 and Styrofoam™ 609 vessels. Ceramic materials can be used for vessels as well.

In FIG. 6, the portable drinking accessories may include: a universal adapter 601, a threaded adapter 602, a magnetic adapter 603, and a contoured adapter 604. These four accessories allow a Vessel Mate™ accessory to attach directly to any of the above-mentioned vessels. A series of lid inserts may be affixed, attached or juxtaposed to the adapters to enhance the functionality, safety and or appearance of these above described vessels. These lid inserts are generally flat circular in shape with various openings to serve various functions as disclosed below. Accordingly, the threaded adapter 602, magnetic adapter 603, and contoured adapter 604 can each attach to either a glass 605, plastic 606, metal 607, paper 608 and sytrofoam 609 container to convert those containers into drinking vessels for users.

Figure 7:
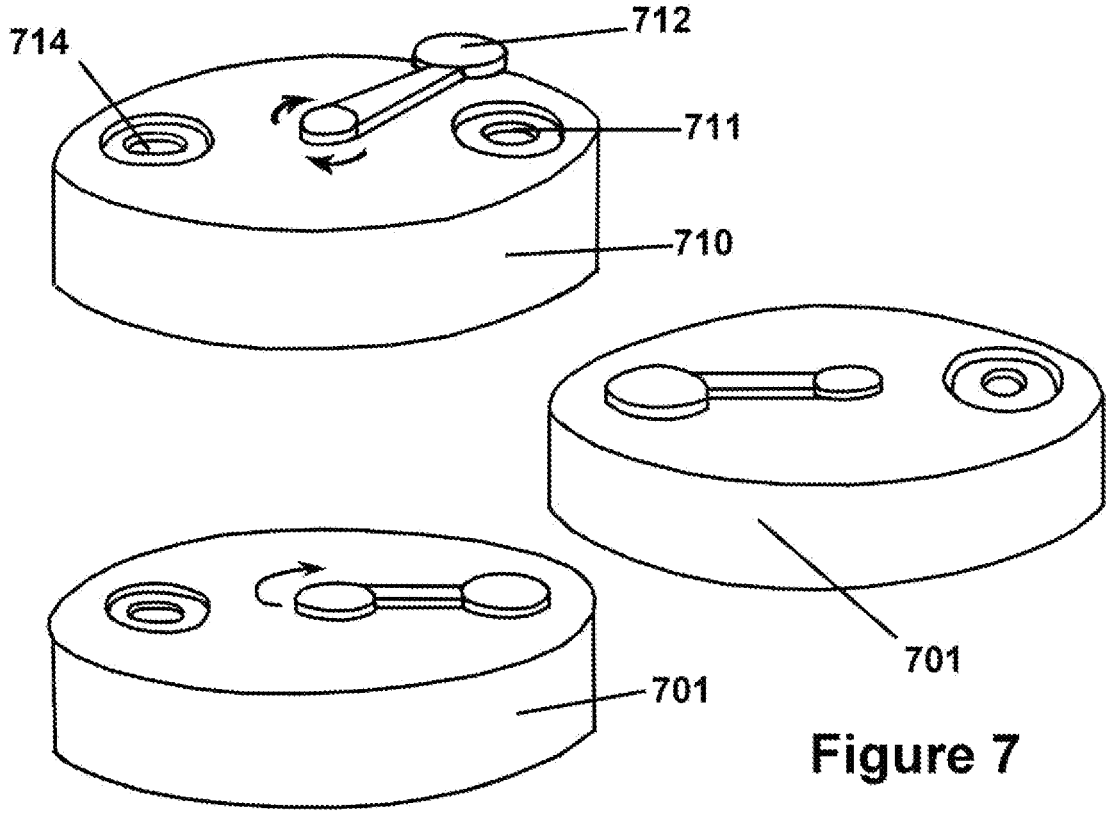
FIG. 7 illustrates one potential embodiment of a lid or top for a drinking accessory for providing an item capable of coupling with an ordinary jar according to the present invention.

FIG. 7 illustrates one potential embodiment of a lid or top for a drinking accessory for providing an item capable of coupling with an ordinary jar according to the present invention. The jars and cans that can be converted into drinking vessels can include a lid or top. FIG. 7 shows a variable flow rate device integral with a main adapter 701. This main adapter 701 consists of two stepped openings, 711 and 714. The shallower step in both openings is the larger diameter and that matches the diameter of the pivoting cap 712. The pivoting cap 712 is attached to an arm which is affixed to the surface at a centrally located pivot hinge 713.

In FIG. 7, the second stepped opening in 711 is very small to allow for a constricted flow rate for extremely hot or cold drinks. As such, when the second stepped opening 711 is in use, the pivoting cap plugs the major stepped opening 714. When the beverage reaches a more neutral temperature and a higher flow rate is desired, the cap can be removed from opening 714, pivoted over, and used to plug opening 711.

Figure 8:
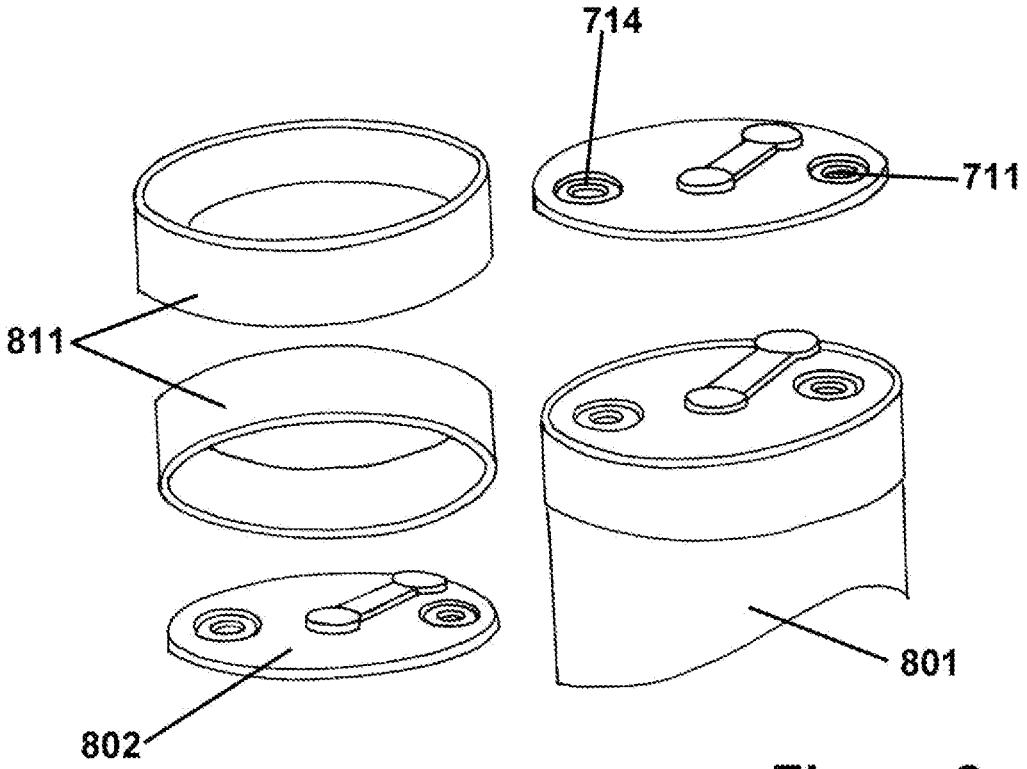
FIG. 8 illustrates another potential embodiment of a lid or top for a drinking accessory for providing an item capable of coupling with an ordinary jar according to the present invention.

FIG. 8 illustrates another potential embodiment of a lid or top for a drinking accessory (such as the jars and cans described above) for providing an item capable of coupling with an ordinary jar or can according to the present invention. FIG. 8 show the same mechanism of FIG. 7 in the form of a modular lid insert 802 and a jar rim 811 which fits into an open vessel adapter 801. This assembly is then firmly attached by various means previously described to a tumbler, jar, or other vessel. The drinking holes and pivoting lid operate as discussed above. The lid or tops can therefore be applied to the jars and cans described above.

Figure 9:
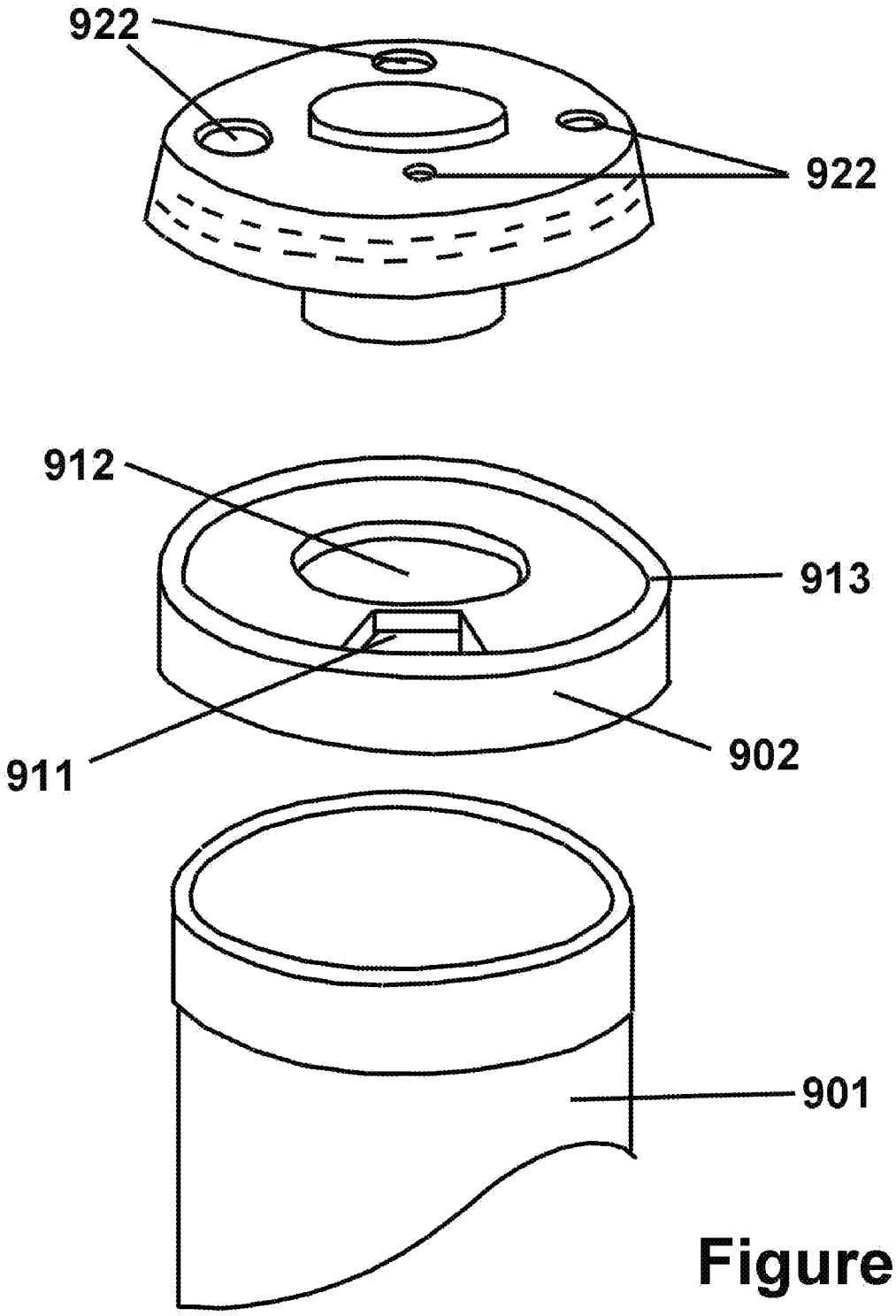
FIG. 9 illustrates yet potential embodiment of a lid or top a drinking accessory for providing an item capable of coupling with an ordinary jar according to the present invention.

FIG. 9 illustrates yet potential embodiment of a lid or top an article of manufacture for providing a drinking accessory capable of coupling with an ordinary jar or can described above in the previous figures according to the present invention. FIG. 9 shows a secondary adapter-cover 903 that couples with an inner cover 921 in which the combination of these two covers mate to vessel 902. The secondary cover 903 consists of multiple openings 922 of graduated sizes to allow for increasing flow rate from very small to larger. The inner cover 902 consists of openings 911 and 912 and an outer rim 913. The secondary cover 903 also has a concave channel on the interior diameter which fits sufficiently and snugly over the inner cover to vertically secure them both together, thereby keeping the secondary cover attached to the adapter-insert which in turn is securely attached to the vessel 902. The diameter of the inner cover is slightly larger than the adapter insert to allow rotation of the secondary cover (shown in FIG. 10) so that any of the graduated openings 922 on the secondary cover align with the minor opening 911 to control the flow rate of the hot or cold drink as desired in the combined vessel 901.

Figure 10:
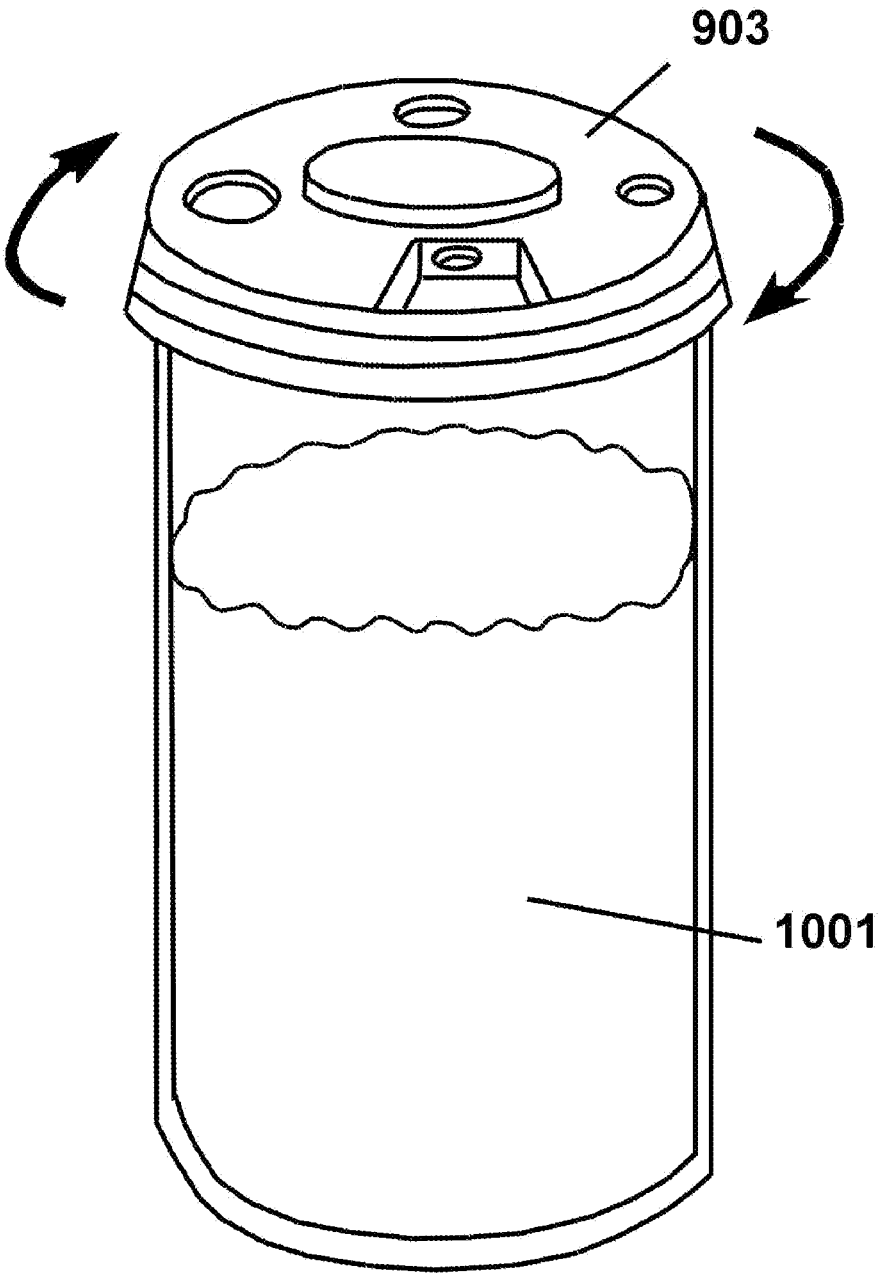
FIG. 10 illustrates one potential embodiment of a jar and lid for providing an item capable of coupling with an ordinary jar or can according to the present invention.

FIG. 10 illustrates another embodiment of a jar and lid for providing an item capable of coupling with an ordinary jar or can according to the present invention. The vessel 1001 of FIG. 10 is similar to the vessel shown in FIG. 9, with the combination of the secondary cover 903 shown in place. The secondary cover 903 rotates as shown to locate one of the multiple sized openings above the opening in the inner cover to permit a user to take in the contents of the vessel 1001.

In other embodiments, it is often desirable to add ice to beverages to cool the temperature of the beverage during hot weather. However, the case can melt well before the user has finished the drink, and the melted ice can also dilute the beverage and the attendant flavorings and desirability of the beverage. In addition, ice is made from tap water that can contain various toxins and pollutants that the user can potentially consume when the ice melts into the liquid. Accordingly, it is desirable to enable the ice to be present in the drinking vessel without melting. The drinking vessel should have the ability to cool the beverage while creating a non-thermal impervious barrier that prevents the melting ice to go into the solution with the beverage and thereby preventing the beverage from being diluted and polluted.

Figure 11A:
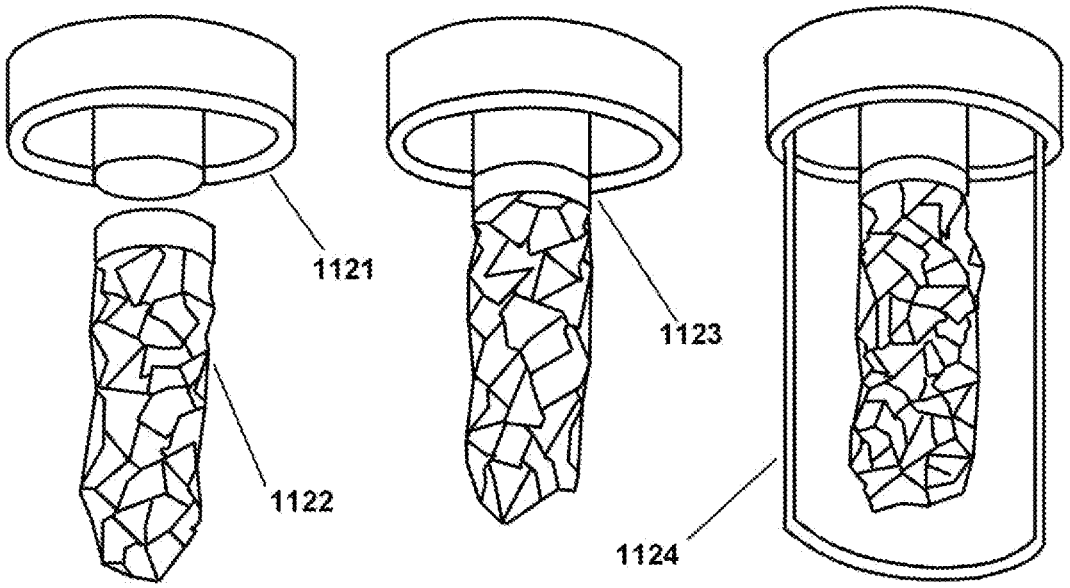
FIG. 11(A)-(B) illustrates another embodiment according to the present invention.

FIG. 11(A) illustrates a main threaded fixture 1121 and a tubular extension 1122. The tubular extension 1122 has openings on top from which to drink the beverage. The threaded fixture 1121 can couple with the tubular extension 1122 as shown with the coupled attachment 1123. The threaded fixture 1121 can be placed on the inside of a drinking vessel, while the tubular extension 1122 can be placed at the top of the drinking vessel, wherein the openings can enable the user drink the hot or cold beverage. Below the coupled threaded fixture 1121 and tubular extension 1122 is a tubular plastic bag 1124 with a mating tubular extension designed to tightly mate with the tubular extension 1122 on the main threaded fixture 1121 by screwing or by a press fit (similar to vacuum cleaner wand extensions) to achieve a tight connection. Ice can be filled into the tubular plastic bag 1124 before connecting to the threaded fixture 1121 or after being connected through a main large central opening that is atop the main threaded fixture 1121.

In FIG. 11(A), once the tubular plastic bag 1124 is filled with ice and attached to the main threaded fixture 1121, the threaded fixture 1121 can be attached to a jar wherein the ice filled tubular plastic bag 1124 is inserted into the beverage that is in the vessel. The thin plastic membrane of the tubular plastic bag 1124 allows thermal conduction of the cold which the ice produces. The beverage is chilled while the ice is prevented from melting and thereby diluting and polluting the beverage. The small openings at the top of the tubular extension 1122 allow users to sip the beverage.

Figure 11B:
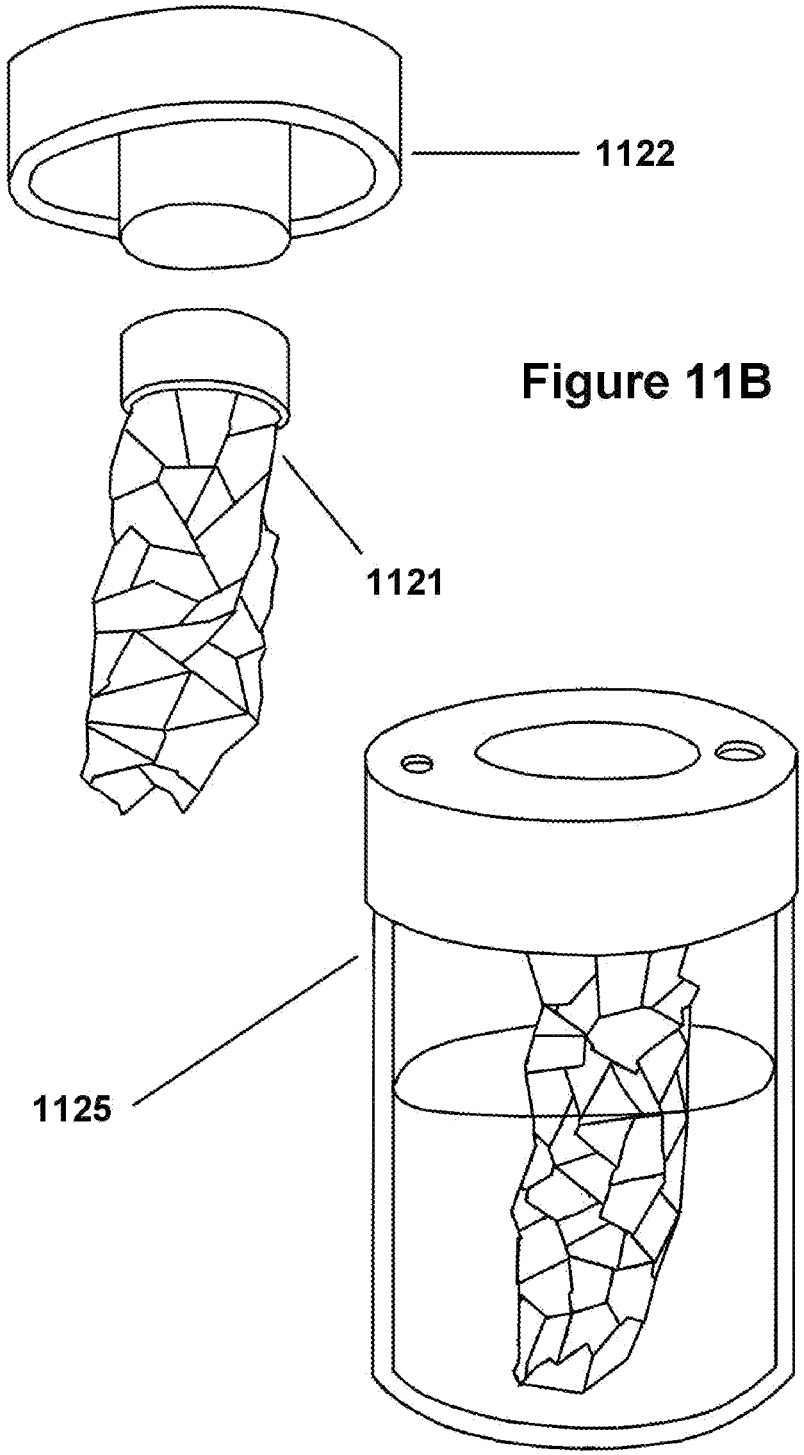

FIG. 11(B) illustrates the threaded fixture 1121, tubular extension 1122 and with ice within a jar/drinking vessel 1125. The tubular plastic bag with the thin plastic membrane and threaded fixture 1121 allows the thermal conduction of the cold that the ice produces. As a result, the beverage within the drinking vessel 1125 is chilled, and the ice is prevented from melting and diluting and polluting the beverage, and the user does not receive any harmful effects from drinking the beverage with melted ice.

Figure 12:
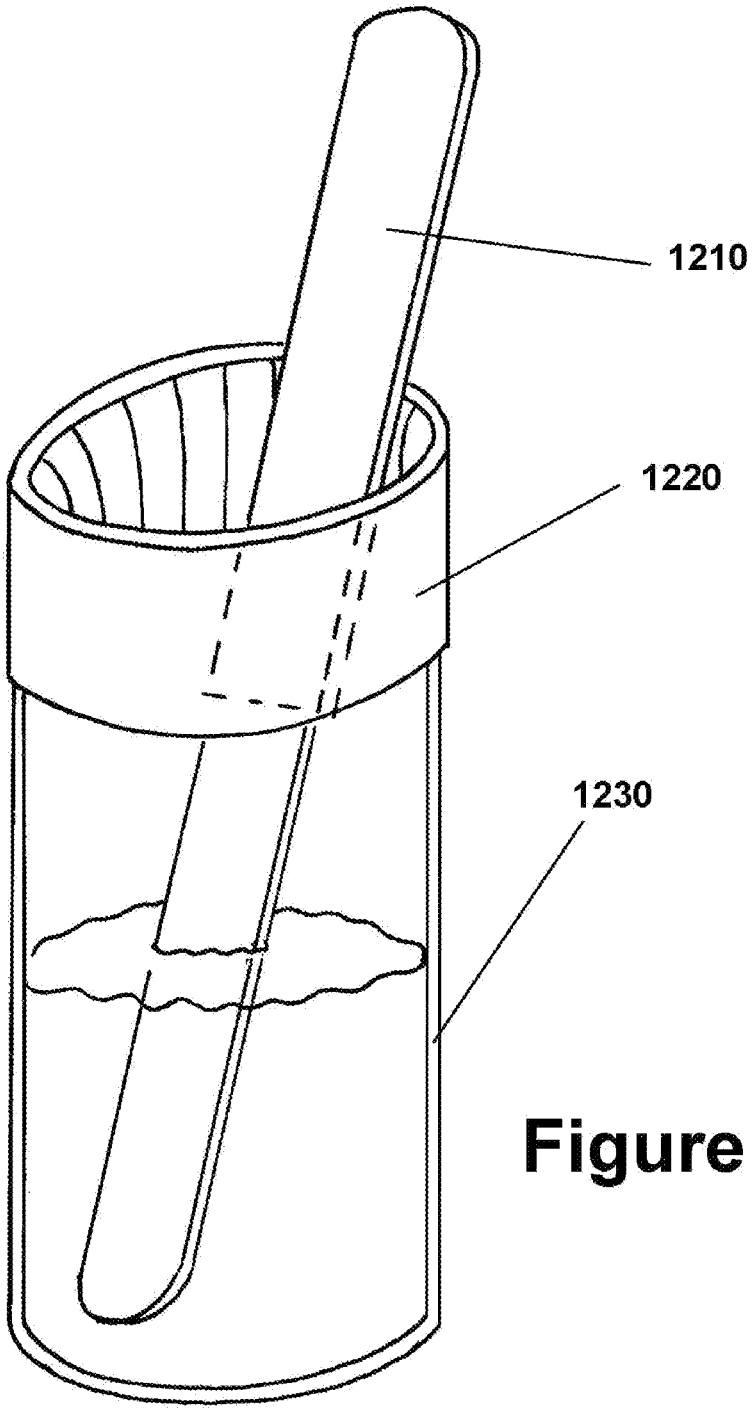
FIG. 12 illustrates another embodiment according to the present invention.

FIG. 12 illustrates a glass jar 1230 with a hot liquid. In cases where glass jars such as glass jar 1220 are used for hot liquids (such as coffee, tea), it is desirable to use a heat sink to prevent the sudden temperature increase from pouring in hot beverages into the glass jar 1230, wherein the glass could potentially be shattered due to the hot liquid. A metal butter knife 1210 placed around the jar rim 1220 can prevent the glass jar 1230 from shattering due to the glass jar 1230 receiving a hot liquid. When, for example, a user pours some hot coffee from a coffee pot into the glass jar 1230, the metal butter knife 1210 can act as a heat sink to absorb the heat from the liquid, and thereby enable the glass jar 1230 to hold the liquid securely. It is preferred to have a heat sink such as the metal butter knife 1210 secured within the glass jar 1230, but also remain in one place and out of the way from a user who wishes to drink the coffee from the glass jar 1230. In other words, the metal butter knife (heat sink) 1210 can remain within the glass jar 1230 as the user drinks the liquid from the glass jar 1230 without excessively protruding out of the glass jar 1230 and contacting the user in a harmful way, such as poking the user in the nose or the eye, or scratching the user's hand.

Figure 13A:
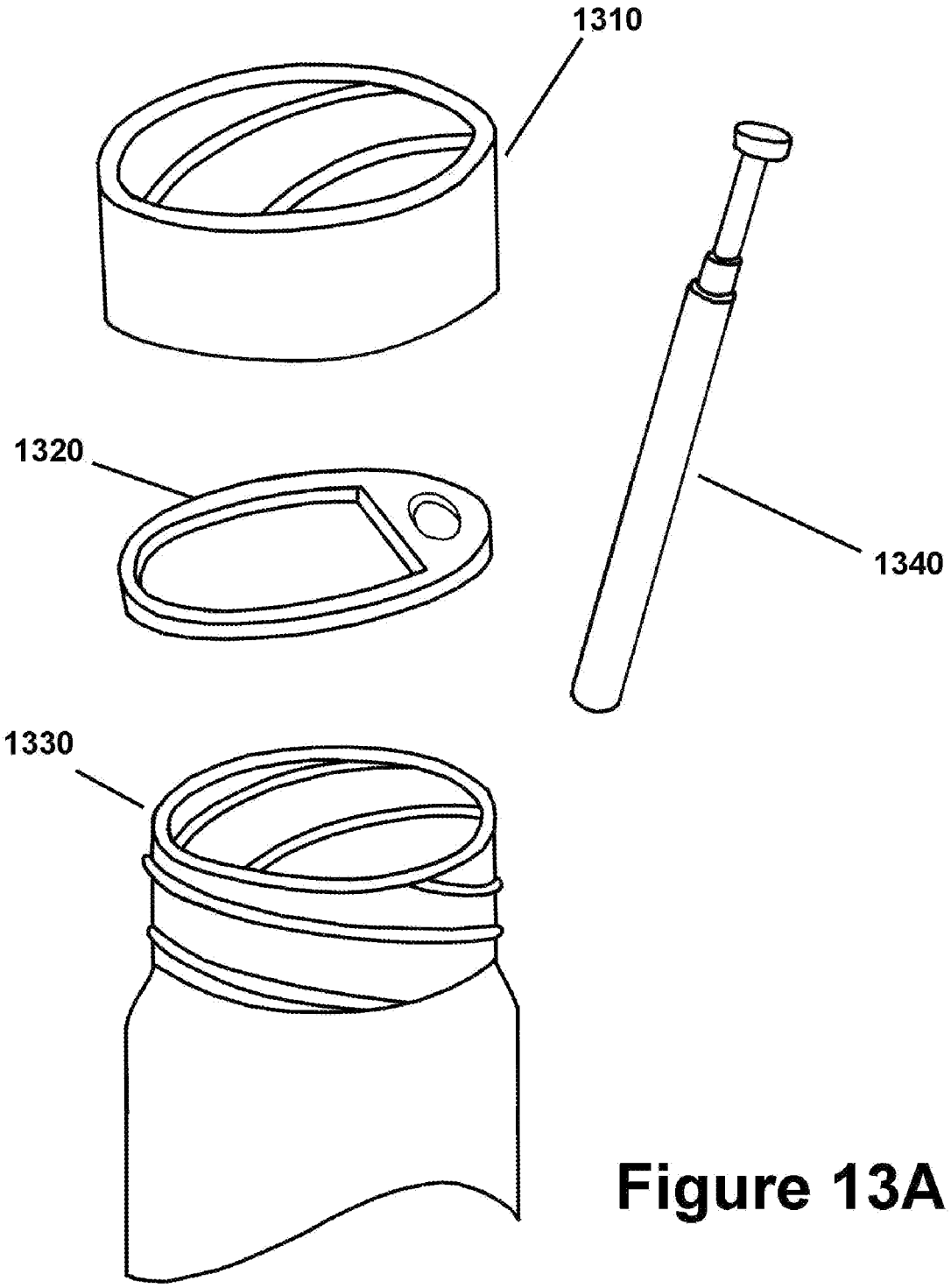
FIG. 13(A)-(B) illustrates another embodiment according to the present invention.

FIG. 13(A) illustrates a thread fixture 1310, a flat adaptor disc 1320, a height adjustable metal heat sink 1340, and a threaded jar 1330. The thread fixture 1310 can mate with the flat adaptor disc 1320. The threads around the top perimeter of the threaded jar 1330 enable the thread fixture 1310 and flat adaptor disc 1320 to be placed on the threaded jar 1330. The height adjustable metal sink 1340 can be placed in an opening into the threaded jar 1330 that includes the flat adaptor disc 1320 and the thread fixture 1310. The height adjustable metal heat sink 1340 can absorb the heat of hot and warm liquids such as coffee, tea, milk, or the like. As such, the threaded jar 1330 remains intact due to the height adjustable metal heat sink 1340 absorbing the heat from the hot/warm liquid. Further, the height adjustable metal heat sink 1340 will not excessively protrude outside of the threaded jar 1330 when a user is using the threaded jar 1330 to drink the hot/warm liquid.

Figure 13B:
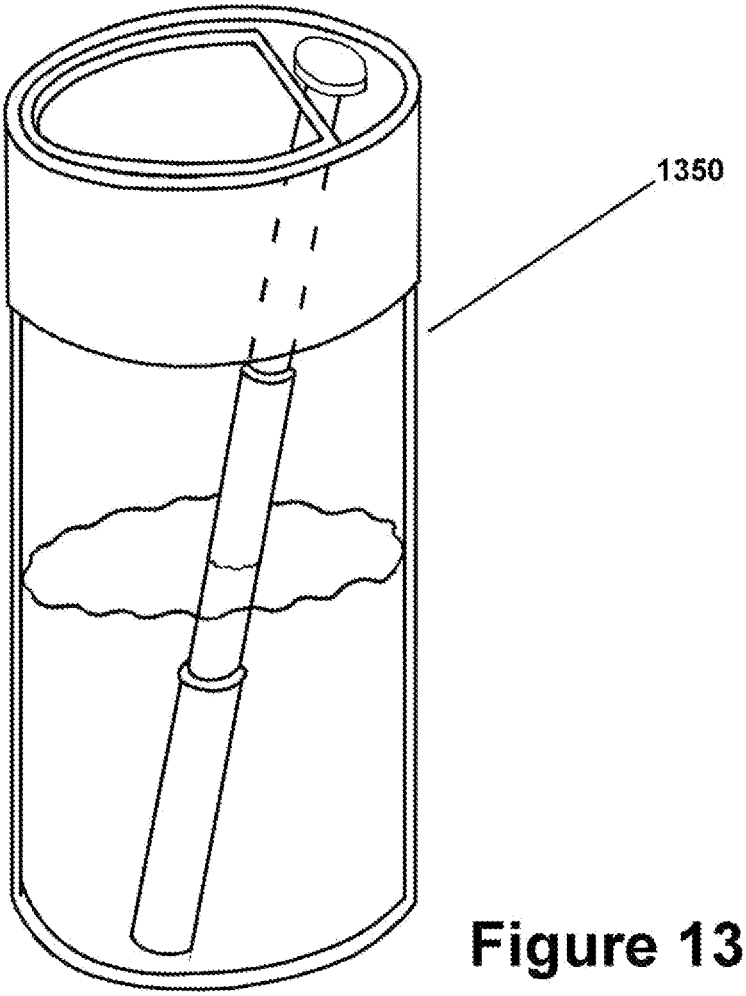

FIG. 13(B) illustrates the components of thread fixture, flat adaptor disc, height adjustable metal heat sink and threaded jar being coupled and in use within a container 1350. The user can drink the liquid through the opening of the flat adaptor disc within the container 1350 without any interference from the height adjustable metal heat sink, in which the height adjustable metal heat sink will contact inhibit the user or contact the user in any harmful way.

Figure 14A:
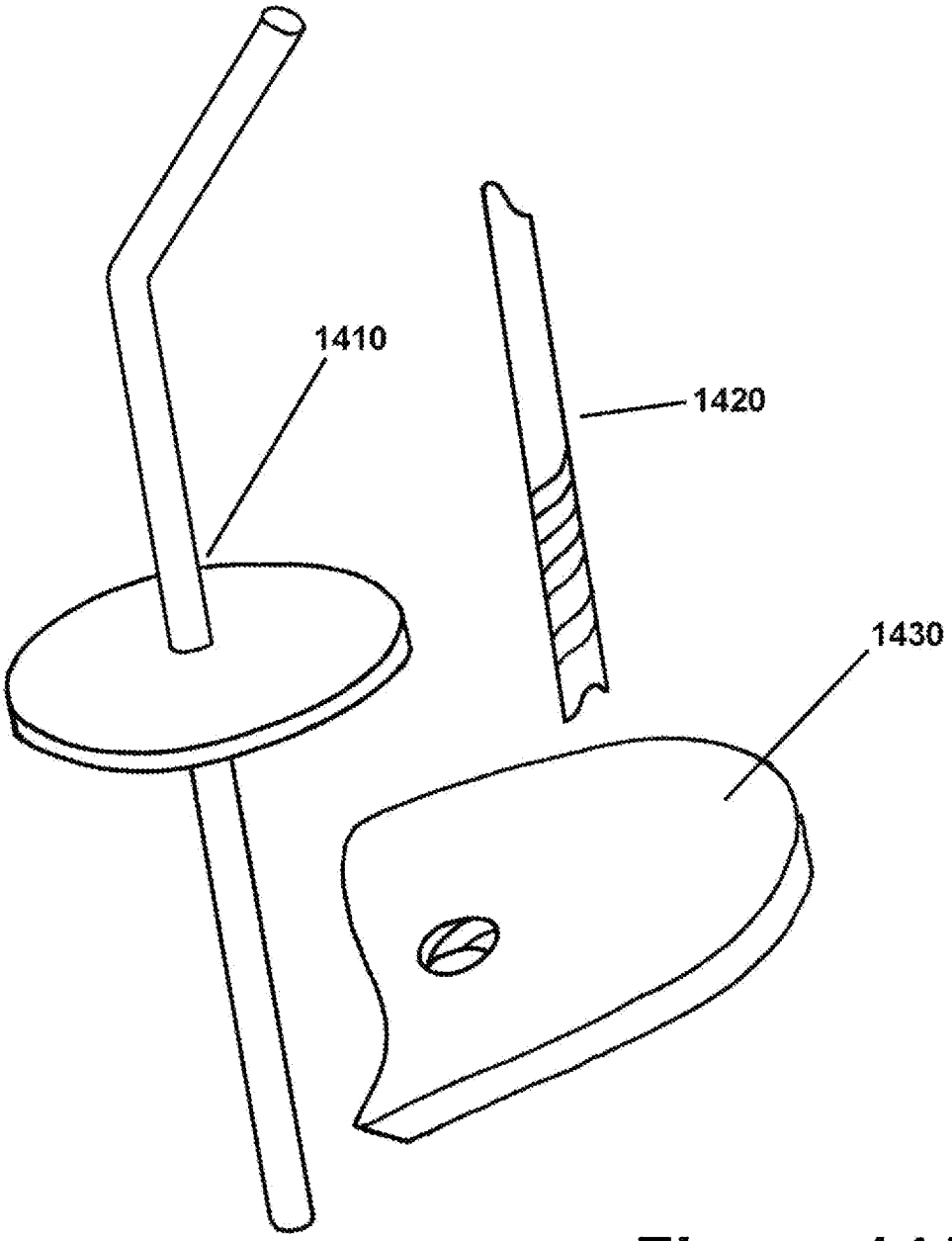
FIG. 14(A)-(B) illustrates another embodiment according to the present invention.

FIG. 14(A) illustrates a disc 1430 which can fit into a straw/threaded fixture 1420. The hole opening in the disc 1430 has a threaded surface to accommodate the straw 1420 that has a corresponding threaded surface. The threaded surface of the straw 1420 is configured around the midsection area of the straw 1420. As such, the straw 1420 can have a tight seal 1410 with the disc 1430 when the straw 1420 is inserted into the disc 1430. The tight seal 1410 of the straw 1420 within the disc 1430 prevents spillage of the liquid within a container and also helps to insulate the hold or cold beverage within the container.

Figure 14B:
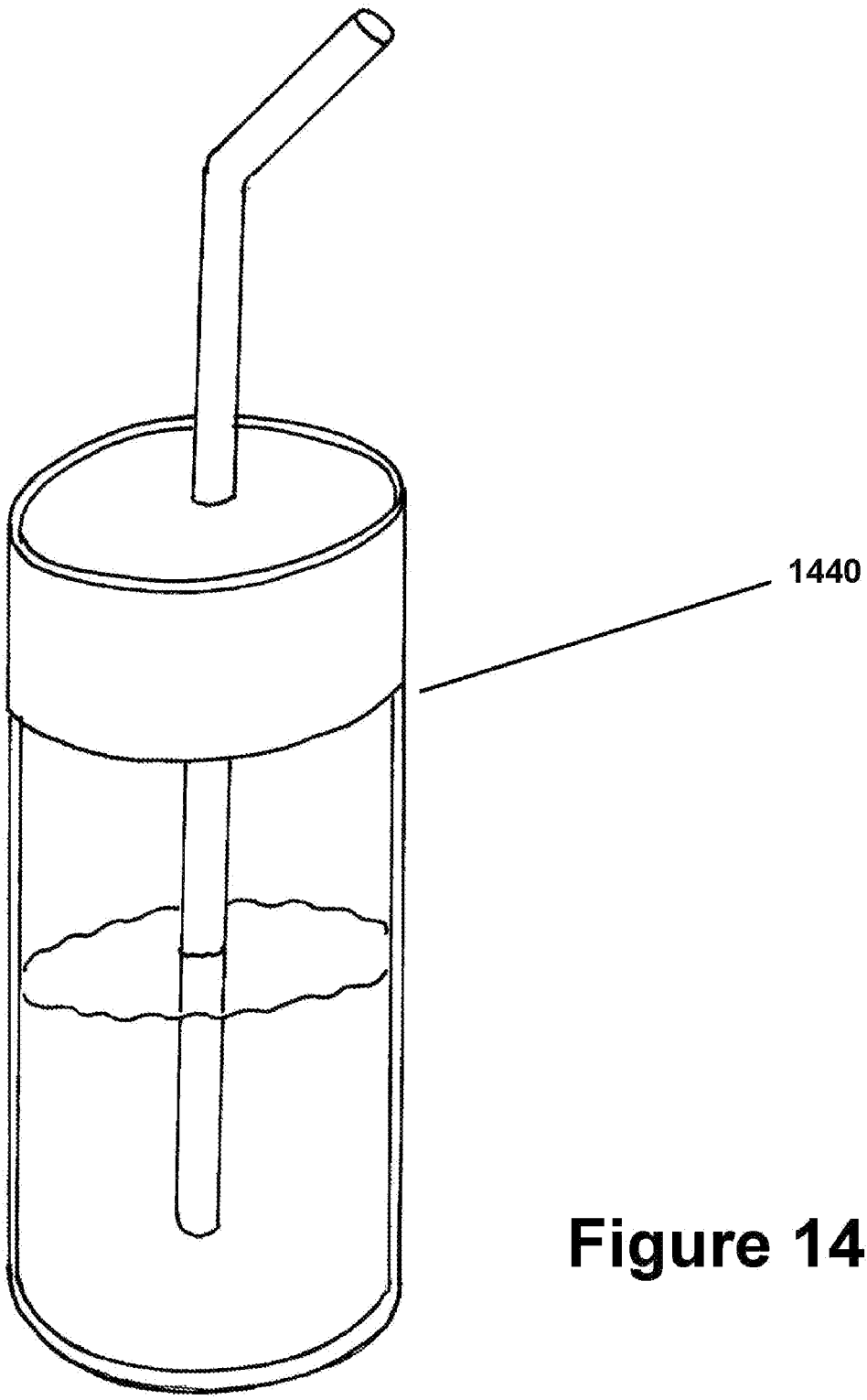

FIG. 14(B) illustrates a container 1440 configured with the disc and placed on top of the container 1440 containing a liquid. The disc readily inserts into the threaded area of the straw, which are then placed onto the jar/container containing the liquid. The tight seal between the straw and the disc helps to insulate the hot or cold liquid within the container 1440.

It will be further understood that various changes in the details, materials, and arrangements of the parts which have been described and illustrated in order to explain embodiments of this invention may be made by those skilled in the art without departing from embodiments of the invention encompassed by the following claims.

In this specification including any claims, the term "each" may be used to refer to one or more specified characteristics of a plurality of previously recited elements or steps. When used with the open-ended term "comprising," the recitation of the term "each" does not exclude additional, unrecited elements or steps. Thus, it will be understood that an apparatus may have additional, unrecited elements and a method may have additional, unrecited steps, where the additional, unrecited elements or steps do not have the one or more specified characteristics.

The invention claimed is:

1. A system comprising:

a jar rim configured at a first position;

a jar lid configured at a second position, wherein the jar lid is configured to be placed in contact with the jar rim and couple with the jar rim, and wherein the coupled jar lid and jar rim are configured to be to connect with one or more liquid containing devices and/or item containing devices;

a holding device configured to hold liquids and/or items, wherein the holding device is configured to connect with the coupled jar lid and jar rim and provide an additional use based on the holding device being connected to the coupled jar lid and jar rim, wherein the holding device includes a thermal liner connected to an exterior thread and an interior adapter to create a seal between multiple components, wherein the exterior thread and interior adapter are configured within the thermal liner; and one or more holes configured at a top portion of the coupled jar rim, jar lid and holding device to enable the additional use to be provided.

2. The system of claim 1, wherein the coupled jar lid and jar rim provide an opening for a drinking device.

3. The system of claim 1, wherein the thermal liner is configured with a greater radius than a radius of the exterior thread.

4. The system of claim 1, wherein the holding device consists of aluminum.

5. The system of claim 1, wherein the jar rim is configured to match a shape of the holding device.

* * * * *